United States Patent [19]

Dickerson et al.

[11] Patent Number: 4,994,355

[45] Date of Patent: Feb. 19, 1991

[54] RADIOGRAPHIC ELEMENTS WITH SELECTED CONTRAST RELATIONSHIPS

[75] Inventors: Robert E. Dickerson, Rochester; Phillip C. Bunch, Brighton, both of N.Y.

[73] Assignee: Eastman Kodak Company, Rochester, N.Y.

[21] Appl. No.: 502,220

[22] Filed: Mar. 29, 1990

Related U.S. Application Data

[63] and a continuation-in-part of Ser. No. 385,128, Jul. 26, 1989, which is a continuation of Ser. No. 314,339, Feb. 23, 1989, abandoned.

[51] Int. Cl.[5] ..... G03C 1/08

[52] U.S. Cl. ..... 430/509; 430/963; 430/966

[58] Field of Search ..... 430/509, 963, 966

[56] References Cited

U.S. PATENT DOCUMENTS

| | | | |
|---|---|---|---|
| 4,425,425 | 1/1984 | Abbott et al. | 430/502 |
| 4,425,426 | 1/1984 | Abbott et al. | 430/502 |
| 4,707,435 | 11/1987 | Lyons et al. | 430/494 |
| 4,710,637 | 12/1987 | Luckey et al. | 250/486.1 |
| 4,803,150 | 2/1989 | Dickerson et al. | 430/502 |
| 4,900,652 | 2/1990 | Dickerson et al. | 430/502 |

FOREIGN PATENT DOCUMENTS 276497 8/1988 European Pat. Off. .

OTHER PUBLICATIONS

K. Rossman & G. Sanderson, "Validity of the Modulation Transfer Function of Radiographic Screen-Film Systems Measured by the Slit Method", *Phys. Med. Biol.*, 1968, vol. 13, No. 2, pp. 259-268.

*Research Disclosure*, vol. 184, Aug. 1979, Item 18431, Section V. Cross-Over Exposure Control.

*Primary Examiner*—Paul R. Michl
*Assistant Examiner*—Janet C. Baxter
*Attorney, Agent, or Firm*—Carl O. Thomas

[57] ABSTRACT

A double coated radiographic element is disclosed which exhibits a crossover of less than 5 percent and which is provided with a first silver halide emulsion layer unit on one side of its transparent film support that exhibits an average contrast of less than 2.0 and a second silver halide emulsion layer unit on the opposite side of the silm support that exhibits an average contrast of at least 2.5.

14 Claims, 1 Drawing Sheet

RADIOGRAPHIC ELEMENTS WITH SELECTED CONTRAST RELATIONSHIPS

FIELD OF THE DISCLOSURE

The invention relates to radiographic imaging. More specifically, the invention relates to double coated silver halide radiographic elements of the type employed in combination with intensifying screens.

BACKGROUND

In medical radiography an image of a patient's tissue and bone structure is produced by exposing the patient to X radiation and recording the pattern of penetrating X radiation using a radiographic element containing at least one radiation sensitive silver halide emulsion layer coated on a transparent (usually blue tinted) film support. The X radiation can be directly recorded by the emulsion layer where only limited areas of exposure are required, as in dental imaging and the imaging of body extremities. However, a more efficient approach, which greatly reduces X radiation exposures, is to employ an intensifying screen in combination with the radiographic element. The intensifying screen absorbs X radiation and emits longer wavelength electromagnetic radiation which silver halide emulsions more readily absorb. Another technique for reducing patient exposure is to coat two silver halide emulsion layers on opposite sides of the film support to form a "double coated" radiographic element.

Diagnostic needs can be satisfied at the lowest patient X radiation exposure levels by employing a double coated radiographic element in combination with a pair of intensifying screens. The silver halide emulsion layer unit on each side of the support directly absorbs about 1 to 2 percent of incident X radiation. The front screen, the screen nearest the X radiation source, absorbs a much higher percentage of X radiation, but still transmits sufficient X radiation to expose the back screen, the screen farthest from the X radiation source. In the overwhelming majority of applications the front and back screens are balanced so that each absorbs about the same proportion of the total X radiation. However, a few variations have been reported from time to time. A specific example of balancing front and back screens to maximize image sharpness is provided by Luckey et al U.S. Pat. No. 4,710,637. Lyons et al U.S. Pat. No. 4,707,435 discloses in Example 10 the combination of two proprietary screens, Trimax 2 TM employed as a front screen and Trimax 12F TM employed as a back screen. K. Rossman and G. Sanderson, "Validity of the Modulation Transfer Function of Radiographic Screen Film Systems Measured by the Slit Method", Phys. Med. Biol., 1968, vol. 13, no. 2, pp. 259–268, report the use of unsymmetrical screen film assemblies in which either the two screens had measurably different optical characteristics or the two emulsions had measurably different optical properties.

An imagewise exposed double coated radiographic element contains a latent image in each of the two silver halide emulsion units on opposite sides of the film support. Processing converts the latent images to silver images and concurrently fixes out undeveloped silver halide, rendering the film light insensitive. When the film is mounted on a view box, the two superimposed silver images on opposite sides of the support are seen as a single image against a white, illuminated background.

It has been a continuing objective of medical radiography to maximize the information content of the diagnostic image while minimizing patient exposure to X radiation. In 1918 the Eastman Kodak Company introduced the first medical radiographic product that was double coated, and the Patterson Screen Company that same year introduced a matched intensifying screen pair for that product.

An art recognized difficulty with employing double coated radiographic elements in combination with intensifying screens as described above is that some light emitted by each screen passes through the transparent film support to expose the silver halide emulsion layer unit on the opposite side of the support to light. The light emitted by a screen that exposes the emulsion layer unit on the opposite side of the support reduces image sharpness. The effect is referred to in the art as crossover.

A variety of approaches have been suggested to reduce crossover, as illustrated by *Research Disclosure* Vol. 184, August 1979, Item 18431, Section V. Cross-Over Exposure Control. *Research Disclosure* is published by Kenneth Mason Publications, Ltd., Dudley Annex, 21a North Street, Emsworth, Hampshire P010 7DQ, England. While some of these approaches are capable of entirely eliminating crossover, they either interfere with (typically entirely prevent) concurrent viewing of the superimposed silver images on opposite sides of the support as a single image, require separation and tedious manual reregistration of the silver images in the course of eliminating the crossover reduction medium, or significantly desensitize the silver halide emulsion. As a result, none of these crossover reduction approaches have come into common usage in the radiographic art. An example of a recent crossover cure teaching of this type is Bollen et al European published patent application 276,497, which interposes a reflective support between the emulsion layer units during imaging.

The most successful approach to crossover reduction yet realized by the art consistent with viewing the superimposed silver images through a transparent film support without manual registration of images has been to employ double coated radiographic elements containing spectrally sensitized high aspect ratio tabular grain emulsions or thin intermediate aspect ratio tabular grain emulsions, illustrated by Abbott et al U.S. Pat. Nos. 4,425,425 and 4,425,426, respectively. Whereas radiographic elements typically exhibited crossover levels of at least 25 percent prior to Abbott et al, Abbott et al provide examples of crossover reductions in the 15 to 22 percent range.

Still more recently Dickerson et al (I) U.S. Pat. No. 4,803,150 has demonstrated that by combining the teachings of Abbott et al with a processing solution decolorizable microcrystalline dye located between at least one of the emulsion layer units and the transparent film support "zero" crossover levels can be realized. Since the technique used to determine crossover, single screen exposure of a double coated radiographic element, cannot distinguish between exposure of the emulsion layer unit on the side of the support remote from the screen caused by crossover and the exposure caused by direct absorption of X radiation, "zero" crossover radiographic elements in reality embrace radiographic elements with a measured crossover (including direct X ray absorption) of less than about 5 percent.

Dickerson et al U.S. Pat. No. 4,900,652 (hereinafter referred to as Dickerson et al II) adds to the teachings of Dickerson et al, cited above, specific selections of hydrophilic colloid coating coverages in the emulsion and dye containing layers to allow the "zero" crossover radiographic elements to emerge dry to the touch from a conventional rapid access processor in less than 90 seconds with the crossover reducing microcrystalline dye decolorized.

Although major improvements in radiographic elements have occurred over the years, some limitations have been heretofore accepted as being inherent consequences of the complexities of medical diagnostic imaging. Medical diagnostic imaging places extreme and varying demands on radiographic elements. One of the most difficult demands can be illustrated by the chest X ray. In a typical chest X ray the radiologist is confronted with attempting to visually detect both lung and heart anomalies, even though the X radiation absorption in the heart area is about 10 times greater than that of the lung area. Most double coated radiographic elements when exposed to provide an optimum contrast image of the lungs provide no visually discernable contrast in the image of the heart. This is because the radiographic element is receiving in the heart area only about one tenth the exposure it is receiving in the lung area. The art has prior to this invention attempted to meet the needs of radiologists for chest X ray images providing visually discernable features in both the heart and lung image areas by providing extended latitude radiographic elements. Extended latitude radiographic elements are typically created by employing polydispersed silver halide emulsions to provide lower average contrasts and therefore a wider range of exposures separating minimum and maximum density exposures.

SUMMARY OF THE INVENTION

In one aspect this invention is directed to a radiographic element comprised of a transparent film support, first and second silver halide emulsion layer units coated on opposite sides of the film support, and means for reducing to less than 10 percent crossover of electromagnetic radiation of wavelengths longer than 300 nm capable of forming a latent image in the silver halide emulsion layer units, said crossover reducing means being decolorized in less than 90 seconds during processing of said emulsion layer units.

The radiographic elements are characterized in that the first silver halide emulsion layer unit exhibits an average contrast of less than 2.0, based on density measurements at 0.25 and 2.0 above minimum density and the second silver halide emulsion layer unit exhibits an average contrast of at least 2.5, based on density measurements at 0.25 and 2.0 above minimum density. The contrast of the first silver halide emulsion layer unit is determined with the first silver halide emulsion unit replacing the second silver halide emulsion unit to provide an arrangement with the first silver halide emulsion unit present on both sides of the transparent support, and the contrast of the second silver halide emulsion layer unit is determined with the second silver halide emulsion unit replacing the first silver halide emulsion unit to provide an arrangement with the second silver halide emulsion layer unit present on both sides of the transparent support.

It is has been discovered that these double coated radiographic elements are capable of yielding a greater than 50 percent increase in contrast in heart areas while providing the same contrast in lung areas as conventional extended latitude double coated radiographic elements. The invention therefore represents a significant advance in meeting the diagnostic needs of medical radiologists. Further, while the advantages are discussed in terms of simultaneously obtaining visually useful imaging detail in both heart and lung areas, it is appreciated that the advantages of the invention extend to any imaging application in which the X radiation absorption capabilities of the object being examined differ over a wide range.

DESCRIPTION OF PREFERRED EMBODIMENTS

Figure 1:
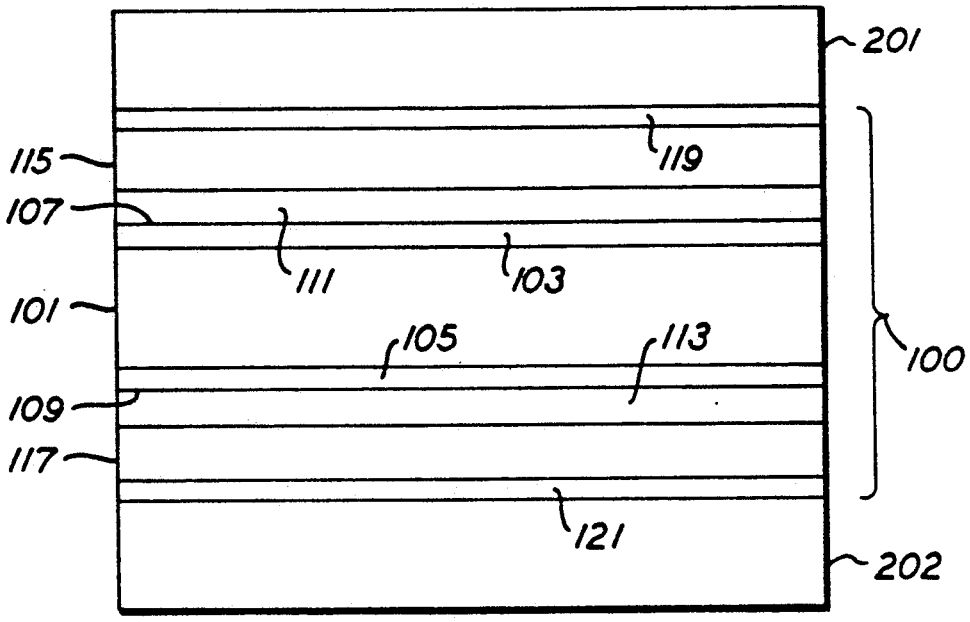
FIG. 1 is a schematic diagram of an assembly consisting of a double coated radiographic element sandwiched between two intensifying screens.

The double coated radiographic elements of this invention offer the capability of producing superimposed silver images capable of transmission viewing which can satisfy the highest standards of the art in terms of speed and sharpness. At the same time the radiographic elements are capable of providing useful imaging detail over a wide range of exposure levels within a single image.

This is achieved by constructing the radiographic element with a transparent film support and first and second emulsion layer units coated on opposite sides of the support. This allows transmission viewing of the silver images on opposite sides of the support after exposure and processing.

Between the emulsion layer units on opposite sides of the support, means are provided for reducing to less than 10 percent crossover of electromagnetic radiation of wavelengths longer than 300 nm capable of forming a latent image in the silver halide emulsion layer units. In addition to having the capability of absorbing longer wavelength radiation during imagewise exposure of the emulsion layer units the crossover reducing means must also have the capability of being decolorized in less than 90 seconds during processing, so that no visual hindrance is presented to viewing the superimposed silver images.

The crossover reducing means reduces crossover to less than 10 percent, preferably reduces crossover to less than 5 percent, and optimally reduces crossover to less than 3 percent. However, it must be kept in mind that for crossover measurement convenience the crossover percent being referred to also includes "false crossover", apparent crossover that is actually the product of direct X radiation absorption. That is, even when crossover of longer wavelength radiation is entirely eliminated, measured crossover will still be in the range of 1 to 2 percent, attributable to the X radiation that is directly absorbed by the emulsion farthest from the intensifying screen. Crossover percentages are determined by the procedures set forth in Abbott et al U.S. Pat. Nos. 4,425,425 and 4,425,426.

In addition to the above requirements, the radiographic elements of this invention differ from conventional double coated radiographic elements in requiring that the first and second emulsion layer units exhibit significantly different average contrasts. The first silver halide emulsion layer unit exhibits an average contrast of less than 2.0 while the second silver halide emulsion layer unit exhibits an average contrast of at least 2.5. It is preferred that the average contrasts of the first and second silver halide emulsion layer units differ by at least 1.0. While the best choice of average contrast differences between the first and second emulsion layer units can differ widely, depending upon the application to be served, in most instances the first and second emulsion layer units exhibit an average contrast difference in the range of from 0.5 to 2.0, optimally from 1.0 to 1.5, where a conventional, uniform intensity source of X-radiation is employed for exposure.

By employing advanced multiple-beam equalization radiography (AMBER) the average contrast differences between the first and second emulsion layer units can be increased, so that average contrast differences in the range of from 0.5 to 3.5, optimally from 1.0 to 2.5, can be employed. These wider ranges of average contrast differences are made possible because of the capability of the AMBER exposure system to sense and reduce exposure in areas of the radiographic element that would otherwise receive a maximum X-radiation exposure—e.g., lung areas. Thus the AMBER exposure system is, for example, capable of concurrently providing useful heart and lung area imaging detail even though the second emulsion layer unit exhibits higher contrast levels than would normally be used with conventional uniform X-radiation exposure systems employed for heart and lung area imaging. A description of the AMBER exposure system is provided by L. J. Schultze-Kool, D. L. T. Busscher, H. Vlasbloem, J. Hermans, P. C. v. d. Merwe, P. R. Algra and W. Herstel, "Advanced Multiple-Beam Equalization Radiography in Chest Radiology: A Stimulated Nodule Detection Study", Radiology, October 1988, pp. 35–39, here incorporated by reference.

The first and second silver halide emulsion units can exhibit identical or differing speeds. However, since the lower average contrast emulsion layer unit is normally relied upon to provide image detail in areas receiving the least exposure to X-radiation, it is preferred that the lower average contrast emulsion unit exhibit a speed which is at least equal to that of the higher average contrast emulsion layer unit. The lower average contrast emulsion layer unit can exhibit speeds up to 10 times greater than those of the higher average contrast emulsion layer unit. It is generally preferred that lower average contrast emulsion layer unit exhibit a speed ranging from equal to to four times greater than that of the higher average contrast emulsion layer unit.

Customarily sensitometric characterizations of double coated radiographic elements generate characteristic (density vs. log exposure) curves that are the product of two identical emulsion layer units, one coated on each of the two sides of the transparent support. Therefore, to keep contrast and other sensitometric measurements (minimum density, speed, maximum density, etc.) as compatible with customary practices as possible, the contrast and other sensitometric characteristics of the first silver halide emulsion layer unit are determined with the first silver halide emulsion unit replacing the second silver halide emulsion unit to provide an arrangement with the first silver halide emulsion unit present on both sides of the transparent support. The contrast and other sensitometric characteristics of the second silver halide emulsion layer unit are similarly determined with the second silver halide emulsion unit replacing the first silver halide emulsion unit to provide an arrangement with the second silver halide emulsion unit present on both sides of the transparent support.

As employed herein the term "average contrast" is employed to indicate a contrast determined by reference to an emulsion layer unit characteristic curve at a density of 0.25 above minimum density and at a density of 2.0 above minimum density. The average contrast is the density difference, 1.75, divided by the log of the difference in exposure levels at two reference points on the characteristic curve, where the exposure levels are meter-candle-seconds. As herein employed all references to photographic speed are understood to refer to comparisons of exposure levels at a reference density of 1.0 above minimum density. While the speed and average contrast characteristic curve reference points have been arbitrarily selected, the selections are typical of those employed in the art. For nontypical characteristic curves (e.g., direct positive imaging or unusual curve shapes) other reference densities can be selected.

By reducing or eliminating crossover and employing emulsion layer units differing in average contrast and, optionally, speed, independent radiographic records are formed in a single double coated radiographic element that provide better definition of exposure differences in areas differing in their level of exposure by 10 times (1.0 log E, where E is measured in meter candle seconds). A difference of 1.0 log E is also referred to herein as difference of 100 relative log exposure units. For example, a speed difference of 0.3 log E is a speed difference of 30 log relative exposure units, with one emulsion layer unit exhibiting a speed twice that of the other.

The remaining features of the double coated radiographic elements of this invention can take any convenient conventional form. In a specifically preferred form of the invention the advantages of (1) tabular grain emulsions as disclosed by Abbott et al U.S. Pat. Nos. 4,425,425 and 4,425,426, cited above and here incorporated by reference, hereinafter referred to as T-Grain TM emulsions; (2) sharpness levels attributable to crossover levels of less than 10 percent, (3) crossover reduction without emulsion desensitization or residual stain, and (4) the capability of rapid access processing, are realized in addition to the advantages discussed above.

These additional advantages can be realized by selecting the features of the double coated radiographic element of this invention according to the teachings of Dickerson et al (I) and (II), U.S. Pat. No. 4,803,150 and U.S. Ser. No 217,727, filed July 8, 1988. The following represents a specific preferred selection of features. Referring to FIG. 1, in the assembly shown a radiographic element 100 according to this invention is positioned between a pair of light emitting intensifying screens 201 and 202. The radiographic element support is comprised of a transparent radiographic support element 101, typically blue tinted, capable of transmitting light to which it is exposed and optionally, similarly transmissive subbing units 103 and 105. On the first and second opposed major faces 107 and 109 of the support formed by the under layer units are crossover reducing hydrophilic colloid layers 111 and 113, respectively. Overlying the crossover reducing layers 111 and 113 are light recording latent image forming silver halide emulsion layer units 115 and 117, respectively. Each of the emulsion layer units is formed of one or more hydrophilic colloid layers including at least one silver halide emulsion layer. Overlying the emulsion layer units 115 and 117 are optional hydrophilic colloid protective overcoat layers 119 and 121, respectively. All of the hydrophilic colloid layers are permeable to processing solutions.

In use, the assembly is imagewise exposed to X-radiation. The X-radiation is principally absorbed by the intensifying screens 201 and 202, which promptly emit light as a direct function of X-ray exposure. Considering first the light emitted by screen 201, the light recording latent image forming emulsion layer unit 115 is positioned adjacent this screen to receive the light which it emits. Because of the proximity of the screen 201 to the emulsion layer unit 115 only minimal light scattering occurs before latent image forming absorption occurs in this layer unit. Hence light emission from screen 201 forms a sharp image in emulsion layer unit 115.

However, not all of the light emitted by screen 201 is absorbed within emulsion layer unit 115. This remaining light, unless otherwise absorbed, will reach the remote emulsion layer unit 117, resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201. In an exactly analogous manner the screen 202 produces a sharp image in emulsion layer unit 117, and the light absorbing layers 111 and 113 similarly reduce crossover exposure of the emulsion layer unit 115 by the screen 202.

Following exposure to produce a stored latent image, the radiographic element 100 is removed from association with the intensifying screens 210 and 202 and processed in a rapid access processor-that is, a processor, such as an RP-X-Omat TM processor, which is capable of producing a image bearing radiographic element dry to the touch in less than 90 seconds. Rapid access processors are illustrated by Barnes et al U.S. Pat. No. 3,545,971 and Akio et al published European published patent application No. 248,390.

Since rapid access processors employed commercially vary in their specific processing cycles and selections of processing solutions, the preferred radiographic elements satisfying the requirements of the present invention are specifically identified as being those that are capable of emerging dry to the touch when processed in 90 seconds according to the following reference conditions:

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

The preferred radiographic elements of the present invention make possible the unique combination of advantages set forth above by employing (1) substantially optimally spectrally sensitized tabular grain emulsions in the emulsion layer units to reach low crossover levels while achieving the high covering power and other known advantages of tabular grain emulsions, (2) one or more particulate dyes in the interlayer units to further reduce crossover to less than 10 percent without emulsion desensitization and minimal or no residual dye stain, and (3) hydrophilic colloid swell and coverage levels compatible with obtaining uniform coatings, rapid access processing, and reduced or eliminated wet pressure sensitivity. Each of these features of the invention is discussed in more detail below:

Each under layer unit contains a processing solution hydrophilic colloid and a particulate dye. The total concentration of the microcrystalline dye in both under layer units is sufficient to reduce the crossover of the radiographic element below 10 percent. This can be achieved when the concentration of the dye is chosen to impart to the structure separating the emulsion layer units an optical density of at least 2.00 at the peak wavelength of screen emission to which the emulsion layer units are responsive. Although the dye can be unequally distributed between the two under layer units, it is preferred that each under layer unit contain sufficient dye to raise the optical density of that under layer unit to 1.00. Using the latter value as a point of reference, since it is conventional practice to employ intensifying screen radiographic element combinations in which the peak emulsion sensitivity matches the peak light emission by the intensifying screens, it follows that the dye also exhibits a density of at least 1.00 at the wavelength of peak emission of the intensifying screen. Since neither screen emissions nor emulsion sensitivities are confined to a single wavelength, it is preferred to choose particulate dyes, including combinations of particulate dyes, capable of imparting a density of 1.00 or more over the entire spectral region of significant sensitivity and emission. For radio graphic elements to be used with blue emitting intensifying screens, such as those which employ calcium tungstate or thulium activated lanthanum oxybromide phosphors, it is generally preferred that the particulate dye be selected to produce an optical density of at least 1.00 over the entire spectral region of 400 to 500 nm. For radiographic elements intended to be used with green emitting intensifying screens, such as those employing rare earth (e.g., terbium) activated gadolinium oxysulfide or oxyhalide phosphors, it is preferred that the particulate dye exhibit a density of at least 1.00 over the spectral region of 450 to 550 nm. To the extent the wavelength of emission of the screens or the sensitivities of the emulsion layers are restricted, the spectral region over which the particulate dye must also effectively absorb light is correspondingly reduced.

While particulate dye optical densities of 1.00, chosen as described above, are effective to reduce crossover to less than 10 percent, it is specifically recognized that particulate dye densities can be increased until radiographic element crossover is effectively eliminated. For example, by increasing the particulate dye concentration so that it imparts a density of 2.0 to the radiographic element, crossover is reduced to only 1 percent.

Since there is a direct relationship between the dye concentration and the optical density produced for a given dye or dye combination, precise optical density selections can be achieved by routine selection procedures. Because dyes vary widely in their extinction coefficients and absorption profiles, it is recognized that the weight or even molar concentrations of particulate dyes will vary from one dye or dye combination selection to the next.

The size of the dye particles is chosen to facilitate coating and rapid decolorization of the dye. In general smaller dye particles lend themselves to more uniform coatings and more rapid decolorization. The dye particles employed in all instances have a mean diameter of less than 10.0 μm and preferably less than 1.0 μm. There is no theoretical limit on the minimum sizes the dye particles can take. The dye particles can be most conveniently formed by crystallization from solution in sizes ranging down to about 0.01 μm or less. Where the dyes are initially crystallized in the form of particles larger than desired for use, conventional techniques for achieving smaller particle sizes can be employed, such as ball milling, roller milling, sand milling, and the like.

An important criterion in dye selection is their ability to remain in particulate form in hydrophilic colloid layers of radiographic elements While the hydrophilic colloids can take any of various conventional forms, such as any of the forms set forth in *Research Disclosure,* Vol. 176, December 1978, Item 17643, Section IX, Vehicles and vehicle extenders, here incorporated by reference, the hydrophilic colloid layers are most commonly gelatin and gelatin derivatives (e.g., acetylated or phthalated gelatin). To achieve adequate coating uniformity the hydrophilic colloid must be coated at a layer coverage of at least 10 mg/dm$^2$. Any convenient higher coating coverage can be employed, provided the total hydrophilic colloid coverage per side of the radiographic element does not exceed that compatible with rapid access processing. Hydrophilic colloids are typically coated as aqueous solutions in the pH range of from about 5 to 6, most typically from 5.5 to 6.0, to form radiographic element layers. The dyes which are selected for use in the practice of this invention are those which are capable of remaining in particulate form at those pH levels in aqueous solutions.

Dyes which by reason of their chromophoric make up are inherently ionic, such as cyanine dyes, as well as dyes which contain substituents which are ionically dissociated in the above noted pH ranges of coating may in individual instances be sufficiently insoluble to satisfy the requirements of this invention, but do not in general constitute preferred classes of dyes for use in the practice of the invention. For example, dyes with sulfonic acid substituents are normally too soluble to satisfy the requirements of the invention. On the other hand, nonionic dyes with carboxylic acid groups (depending in some instances on the specific substitution location of the carboxylic acid group) are in general insoluble under aqueous acid coating conditions. Specific dye selections can be made from known dye characteristics or by observing solubilities in the pH range of from 5.5 to 6.0 at normal layer coating temperatures—e.g., at a reference temperature of 40° C.

Preferred particulate dyes are nonionic polymethine dyes, which include the merocyanine, oxonol, hemioxonol, styryl, and arylidene dyes.

The merocyanine dyes include, Joined by a methine linkage, at least one basic heterocyclic nucleus and at least one acidic nucleus. The nuclei can be joined by an even number or methine groups or in so-called "zero methine" merocyanine dyes, the methine linkage takes the form of a double bond between methine groups incorporated in the nuclei. Basic nuclei, such as azolium or azinium nuclei, for example, include those derived from pyridinium, quinolinium, isoquinolinium, oxazolium, pyrazolium, pyrrolium, indolium, oxadiazolium, 3H- or 1H-benzo-indolium, pyrrolopyridinium, phenanthrothiazolium, and acenaphthothiazolium quaternary salts.

Exemplary of the basic heterocyclic nuclei are those satisfying Formulae I and II.

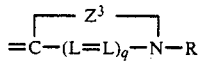
(I)

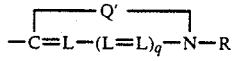
(II)

where $Z^3$ represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), oxadiazole, 2- or 4-pyridine, 2- or 4-quinoline, 1- or 3-isoquinoline, benzoquinoline, 1H- or 3H-benzoindole, and pyrazole, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 2-cyanoethyl, and trifluoromethyl), aryl groups or substituted aryl groups (e.g., phenyl, 1-naphthyl, 2-naphthyl, 3-carboxyphenyl, and 4-biphenylyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolylthio, and 2-naphthylthio), methylenedioxy, cyano, 2-thienyl, styryl, amino or substituted amino groups (e.g., anilino, dimethylamino, diethylamino, and morpholino), acyl groups, (e.g., formyl, acetyl, benzoyl, and benzenesulfonyl);

Q' represents the elements needed to complete a cyclic nucleus derived from basic heterocyclic nitrogen compounds such as pyrrole, pyrazole, indazole, and pyrrolopyridine;

R represents alkyl groups, aryl groups, alkenyl groups, or arkloyl groups, with or without substituents, (e.g., carboxy, hydroxy, sulfo, alkoxy, sulfato, thiosulfato, phosphono, chloro, and bromo substituents);

L is in each occurrence independently selected to represent a substituted or unsubstituted methine group-e.g., —$CR^8$=groups, where $R^8$ represents hydrogen when the methine group is unsubstituted and most commonly represents alkyl of from 1 to 4 carbon atoms or phenyl when the methine group is substituted; and q is 0 or 1.

Merocyanine dyes link one of the basic heterocyclic nuclei described above to an acidic keto methylene nucleus through a methine linkage, where the methine groups can take the form —$CR^8$=described above. The greater the number of the methine groups linking nuclei in the polymethine dyes in general and the merocyanine dyes in particular the longer the absorption wavelengths of the dyes.

Merocyanine dyes link one of the basic heterocyclic nuclei described above to an acidic keto methylene nucleus through a methine linkage as described above. Exemplary acidic nuclei are those which satisfy Formula III.

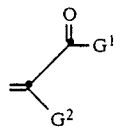

(III)

where $G^1$ represents an alkyl group or substituted alkyl group, an aryl or substituted aryl group, an aralkyl group, an alkoxy group, an aryloxy group, a hydroxy group, an amino group, or a substituted amino group, wherein exemplary substituents can take the various forms noted in connection with Formulae VI and VII;

$G^2$ can represent any one of the groups listed for $G^1$ and in addition can represent a cyano group, an alkyl, or arylsulfonyl group, or a group represented by

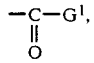

or $G^2$ taken together with $G^1$ can represent the elements needed to complete a cyclic acidic nucleus such as those derived from 2,4-oxazolidinone (e.g., 3-ethyl 2,4-oxazolidindione), 2,4-thiazolidindione (e.g., 3-methyl 2,4-thiazolidin dione), 2-thio 2,4-oxazolidindione (e.g., 3-phenyl 2-thio-2,4-oxazolidindione), rhodanine, such as 3-ethylrhodanine, 3-phenylrhodanine, 3-(3-dimethyl aminopropyl)rhodanine, and 3-carboxymethylrhodanine, hydantoin (e.g., 1,3-diethylhydantoin and 3-ethyl 1-phenylhydantoin), 2-thiohydantoin (e.g., 1-ethyl 3-phenyl-2-thiohydantoin, 3-heptyl 1-phenyl 2-thiohydantoin, and arylsulfonyl 2-thiohydantoin), 2-pyrazolin 5-one, such as 3-methyl-1-phenyl 2-pyrazolin 5-one and 3-methyl 1-(4-carboxyphenyl) 2-pyrazolin 5-one, 2-isoxazolin 5-one (e.g., 3-phenyl 2-isoxazolin 5-one), 3,5-pyrazolidindione (e.g., 1,2-diethyl 3,5-pyrazolidindione and 1,2-diphenyl 3,5-pyrazolidindione), 1,3-indandione, 1,3-dioxane 4,6-dione, 1,3-cyclohexanedione, barbituric acid (e.g., 1-ethylbarbituric acid and 1,3-diethylbarbituric acid, and 2-thiobarbituric acid (e.g., 1,3-diethyl 2-thiobarbituric acid and 1,3-bis(2-methoxyethyl) 2-thiobarbituric acid).

Useful hemioxonol dyes exhibit a keto methylene nucleus as shown in Formula III and a nucleus as shown in Formula IV.

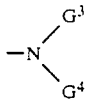

(IV)

where $G^3$ and $G^4$ may be the same or different and may represent alkyl, substituted alkyl, aryl, substituted aryl, or aralkyl, as illustrated for R ring substituents in Formula I or $G^3$ and $G^4$ taken together complete a ring system derived from a cyclic secondary amine, such as pyrrolidine, 3-pyrroline, piperidine, piperazine (e.g., 4-methylpiperazine and phenylpiperazine), morpholine, 1,2,3,4-tetrahydro quinoline, decahydroquinoline, 3-azabicyclo[3,2,2]nonane, indoline, azetidine, and hexahydroazepine.

Exemplary oxonol dyes exhibit two keto methylene nuclei as shown in Formula III Joined through one or higher uneven number of methine groups.

Useful arylidene dyes exhibit a keto methylene nucleus as shown in Formula III and a nucleus as shown in Formula V joined by a methine linkage as described above containing one or a higher uneven number of methine groups

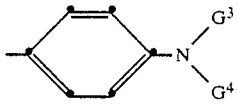

(V)

where $G^3$ and $G^4$ are as previously defined

A specifically preferred class of oxonol dyes for use in the practice of the invention are the oxonol dyes disclosed in Factor and Diehl European published patent application 299,435. These oxonol dyes satisfy Formula VI.

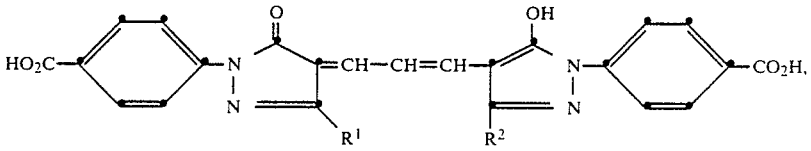

(VI)

wherein $R^1$ and $R^2$ each independently represent alkyl of from 1 to 5 carbon atoms.

A specifically preferred class of arylidene dyes for use in the practice of the invention are the arylidene dyes disclosed in Diehl and Factor European published patent applications 274,723 and 2,94,461. These arylidene dyes satisfy Formula VII.

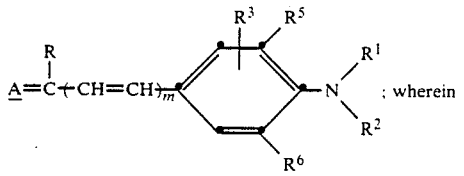

(VII)

; wherein

A represents a substituted or unsubstituted acidic nucleus having a carboxyphenyl or sulfonamidophenyl substituent selected from the group consisting of 2-pryazolin-5-ones free of any substituent bonded thereto through a carboxyl group, rhodanines; hydantoins; 2-thiohydantoins; 4-thiohydantoins; 2,4-oxazolidindiones; 2-thio-2,4-oxazolidindiones; isoxazolinones; barbiturics; 2-thiobarbiturics and indandiones;

R represents hydrogen, alkyl of 1 to 4 carbon atoms or benzyl;

$R^1$ and $R^2$, each independently, represents alkyl or aryl; or taken together with $R^5$, $R^6$, N, and the carbon atoms to which they are attached represent the atoms needed to complete a julolidene ring;

$R^3$ represents H, alkyl or aryl;

$R^5$ and $R^6$, each independently, represents H or $R^5$ taken together with $R^1$; or $R^6$ taken together with $R^2$ each may represent the atoms necessary to complete a 5 or 6-membered ring; and m is 0 or 1.

Oxazole and oxazoline pyrazolone merocyanine particulate dyes of the type disclosed by Factor and Diehl U.S. Ser. No. 137,402, filed Dec. 23, 1987, commonly assigned, are also contemplated. These particulate dyes can be represented by Formula VIII.

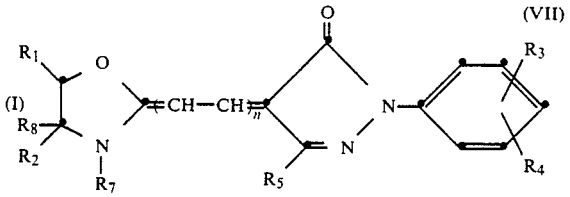

(VII)

(I)

In formula (I), $R_1$ and $R_2$ are each independently substituted or unsubstituted alkyl or substituted or unsubstituted aryl, or together represent the atoms necessary to complete a substituted or unsubstituted 5- or 6-membered ring.

$R_3$ and $R_4$ each independently represents H, substituted or unsubstituted alkyl, substituted or unsubstituted aryl, $CO_2H$, or $NHSO_2R_6$. $R_5$ is H, substituted or unsubstituted alkyl, substituted or unsubstituted aryl, carboxylate (i.e., COOR where R is substituted or unsubstituted alkyl), or substituted or unsubstituted acyl $R_6$ and $R_7$ are each independently substituted or unsubstituted alkyl or substituted or unsubstituted aryl, and n is 1 or 2. $R_8$ is either substituted or unsubstituted alkyl, or is part of a double bond between the ring carbon atoms to which $R_1$ and $R_2$ are attached. At least one of the aryl rings of the dye molecule must have at least one substituent that is $CO_2H$ or $NHSO_2R_6$.

Oxazole and oxazoline benzoylacetonitrile merocyanine particulate dyes of the type disclosed by Factor and Diehl U.S. Ser. No. 290,602, filed Dec. 23, 1988, commonly assigned, cited above, are also contemplated. These particulate dyes can be represented by Formula IX.

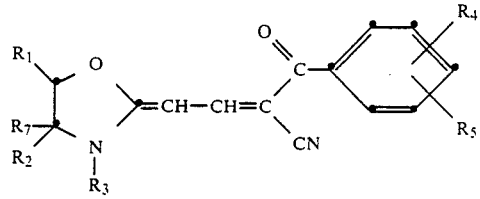

(IX)

In Formula IX, $R_1$, $R_2$, $R_3$, $R_4$, $R_5$, and $R^6$ may each be substituted or unsubstituted alkyl or substituted or unsubstituted aryl, preferably substituted or unsubstituted alkyl of 1 to 6 carbon atoms or substituted or unsubstituted aryl of 6 to 12 carbon atoms. $R_7$ may be substituted or unsubstituted alkyl of from 1 to 6 carbon atoms. The alkyl or aryl groups may be substituted with any of a number of substituents as is known in the art, other than those, such as sulfo substituents, that would tend to increase the solubility of the dye so much as to cause it to become soluble at coating pH's. Examples of useful substituents include halogen, alkoxy, ester groups, amido, acyl, and alkylamino. Examples of alkyl groups include methyl, ethyl, n-propyl, isopropyl, n-butyl, isobutyl, n-pentyl, n-hexyl, or isohexyl. Examples of aryl groups include phenyl, naphthyl, anthracenyl, pyridyl, and styryl.

$R_1$ and $R_2$ may also together represent the atoms necessary to complete a substituted or unsubstituted 5- or 6-membered ring, such as phenyl, naphthyl, pyridyl, cyclohexyl, dihydronaphthyl, or acenaphthyl. This ring may be substituted with substituents, other than those, such as sulfo substituents, that would tend to increase the solubility of the dye so much as to cause it to become soluble at coating pH's. Examples of useful substituents include halogen, alkyl, alkoxy, ester, amido, acyl, and alkylamino.

Useful bleachable particulate dyes can be found among a wide range of cyanine, merocyanine, oxonol, arylidene (i.e., merostyryl), anthraquinone, triphenylmethine, azo, azomethine, and other dyes, provided certain criteria are met identified in Diehl and Factor U.S. Ser. No. 137,495, filed Dec. 23, 1987, commonly assigned. Such dyes satisfy Formula X.

$$[D-(A)_y]-X_n \qquad (x)$$

where D is a chromophoric light-absorbing compound, which may or may not comprise an aromatic ring if y is not O and which comprises an aromatic ring if y is O, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 8 or above.

Synthesis of the particulate dyes can be achieved by procedures known in the art for the synthesis of dyes of the same classes For example, those familiar with techniques for dye synthesis disclosed in "*The Cyanine Dyes and Related Compounds*", Frances Hamer, Interscience Publishers, 1964, could readily synthesize the cyanine, merocyanine, merostyryl, and other polymethine dyes. The oxonol, anthraquinine, triphenylmethane, azo, and azomethine dyes are either known dyes or substituent variants of known dyes of these classes and can be synthesized by known or obvious variants of known synthetic techniques forming dyes of these classes. Specific illustrations of dye preparations are incorporated in the Appendix of Dickerson et al (I) U.S. Pat. No. 4,803,150, here incorporated by reference.

Examples of particulate bleachable dyes useful in the practice of this invention include the following:

TABLE I

Trimethine Pyrazolone Cinnamylidene Dyes

General Structure:

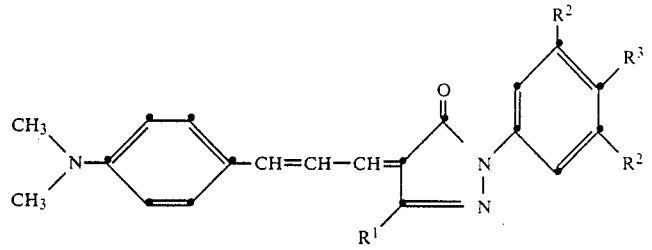

| Dye | $R^1$ | $R^2$ | $R^3$ | λ-max | ε-max (× $10^4$) (methanol) |
|---|---|---|---|---|---|
| 1 | $CH_3$ | H | $CO_2H$ | 516 | 4.62 |
| 2 | $CH_3CO$ | H | $CO_2H$ | 573 | 5.56 |
| 3 | $CO_2Et$ | H | $CO_2H$ | 576 | 5.76 |
| 4 | $CH_3$ | $CO_2H$ | H | 506 | 3.90 |
| 5 | $CO_2Et$ | $CO_2H$ | H | 560 | 5.25 |

TABLE II

Benzoylacetonitrile Merocyanine Dyes

General Structure:

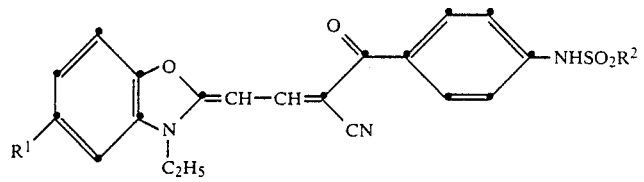

| Dye | $R^1$ | $R^2$ | λ-max | ε-max (× $10^4$) (methanol) |
|---|---|---|---|---|
| 6 | n-$C_6H_{13}SO_2NH$ | $CH_3$ | 445 | 7.32 |
| 7 | $CH_3SO_2NH$ | $C_3H_7$ | 446 | 7.86 |
| 8 | $CH_3SO_2NH$ | n-$C_6H_{13}$ | 447 | 7.6 |
| 9 | H | $CH_3$ | 449 | 6.5 |

TABLE II-A

Arylidene Dyes

General Structure:

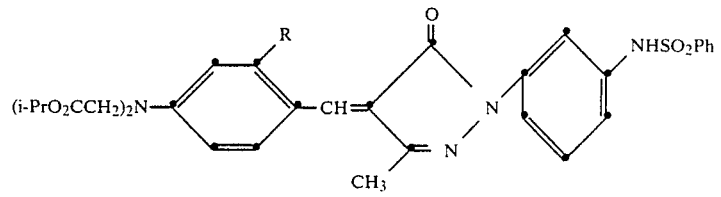

| Dye | R | λ-max | ε-max (× $10^4$) (methanol) |
|---|---|---|---|
| 10 | H | 424 | 3.98 |
| 11 | $CH_3$ | 423 | 3.86 |

TABLE III

Benzoylacetonitrile Arylidene Dyes
General Structure:

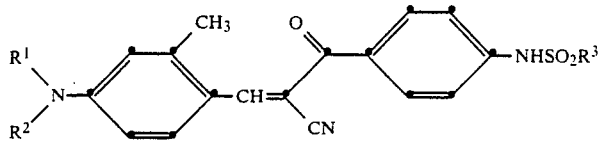

| Dye | $R^1$ | $R^2$ | $R^3$ | λ-max | ε-max (× $10^4$) (methanol) |
|---|---|---|---|---|---|
| 12 | i-$PrO_2CCH_2$ | i-$PrO_2CCH_2$ | $C_3H_7$ | 426 | 3.5 |
| 13 | $C_2H_5$ | $CF_3CH_2O_2CCH_2$ | $CH_3$ | 439 | 4.27 |
| 14 | i-$PrO_2CCH_2$ | i-$PrO_2CCH_3$ | $CH_3$ | 420 | 4.2 |
| 15 | $C_2H_5$ | $CF_3CH_2O_2CCH_2$ | $C_3H_7$ | 430 | 4.25 |

TABLE IV

Pyrazolone Merocyanines Dyes
General Structure:

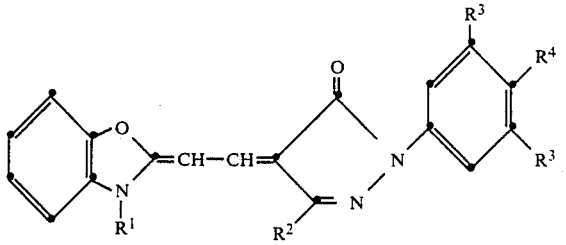

| Dye | $R^1$ | $R^2$ | $R^3$ | $R^4$ | λ-max | εmax (× $10^4$) (methanol) |
|---|---|---|---|---|---|---|
| 16 | $C_2H_5$ | $CH_3$ | H | $CO_2H$ | 450 | 7.4 |
| 17 | $C_2H_5$ | $CH_3$ | $CO_2H$ | H | 452 | 7.19 |

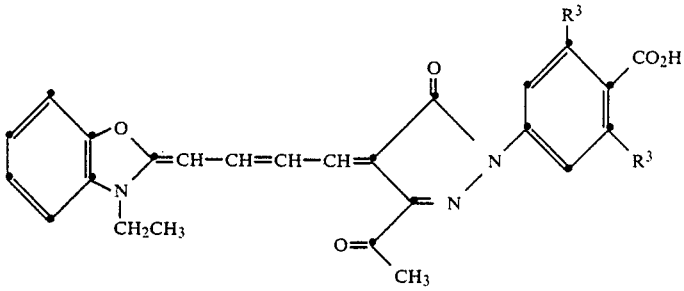

λ-max 562 nm (methanol) ε-max = 11.9 × $10^4$

TABLE V

Barbituric Acid Merocyanines Dyes
General Structure:

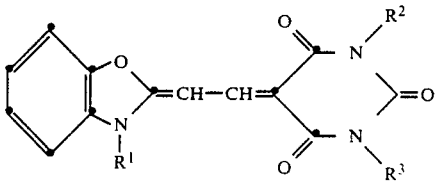

| Dye | $R^1$ | $R^2$ | $R^3$ | λ-max | ε-max (× $10^4$) (methanol) |
|---|---|---|---|---|---|
| 19 | $CH_2PhCO_2H$ | $C_2H_5$ | $C_2H_5$ | 442 | 10.70 |

TABLE VI

Benzoxazole Benzoylacetonitrile Merocyanine Dyes
General Structure:

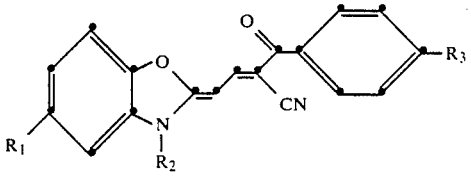

| Dye | $R^1$ | $R^2$ | $R^3$ |
|---|---|---|---|
| 20 | — | Et | $MeOEtSO_2NH$ |
| 21 | — | Me | $MeSO_2NH$ |
| 22 | $MeOEtSO_2NH$ | Et | $MeOEtSO_2NH$ |
| 23 | $MeOEtSO_2NH$ | Et | $HexSO_2NH$ |
| 24 | $MeSO_2NH$ | MeOEt | $MeSO_2NH$ |
| 25 | — | $CH_2PhCO_2H$ | $PrSO_2NH$ |

TABLE VI-continued

Benzoxazole Benzoylacetonitrile Merocyanine Dyes
General Structure:

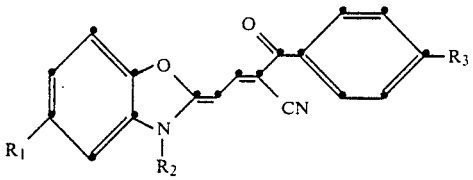

| Dye | $R^1$ | $R^2$ | $R^3$ |
|---|---|---|---|
| 26 | $MeSO_2NH$ | MeOEt | $PrSO_2NH$ |
| 27 | $MeOEtSO_2NH$ | MeOEt | $PrSO_2NH$ |
| 28 | $EtSO_2NH$ | Et | $MeSO_2NH$ |
| 29 | $EtSO_2NH$ | Me | $MeSO_2NH$ |
| 30 | $MeOEtSO_2NH$ | MeOEt | $MeOEtSO_2NH$ |
| 31 | $HexSO_2NH$ | MeOEt | $MeSO_2NH$ |
| 32 | $MeOEtSO_2NH$ | MeOEt | $HexSO_2NH$ |
| 33 | — | $CH_2PhCO_2H$ | $MeSO_2NH$ |
| 34 | $MeSO_2NH$ | Me | $MeSO_2NH$ |
| 35 | $CO_2H$ | Me | $MeSO_2NH$ |
| 36 | $CO_2H$ | Me | $PrSO_2NH$ |

TABLE VI-continued

Benzoxazole Benzoylacetonitrile Merocyanine Dyes
General Structure:

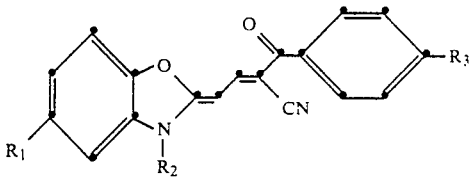

| Dye | $R^1$ | $R^2$ | $R^3$ |
|---|---|---|---|
| 37 | $EtOEtOEtSO_2NH$ | Et | $MeSO_2NH$ |
| 38 | $EtOEtOEtSO_2NH$ | Et | $PrSO_2NH$ |
| 39 | $PrSO_2NH$ | Et | $MeSO_2NH$ |
| 40 | $PrSO_2NH$ | Me | $MeSO_2NH$ |
| 41 | $MeSO_2NH$ | Et | $EtSO_2NH$ |
| 42 | $EtSO_2NH$ | Et | $EtSO_2NH$ |
| 43 | $BuSO_2NH$ | Et | $MeSO_2NH$ |
| 44 | $BuSO_2NH$ | Et | $CO_2H$ |
| 45 | $BuSO_2NH$ | Me | $MeSO_2NH$ |
| 46 | $MeSO_2NH$ | Et | $BuSO_2NH$ |

TABLE VII

Miscellaneous Dyes

Dye

47

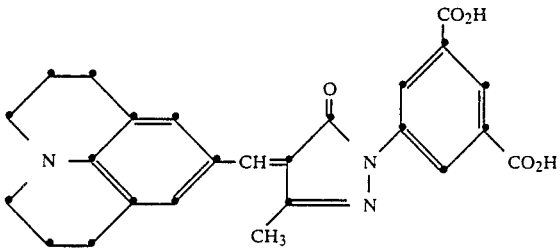

λ-max = 502 nm
ε-max = $5.47 \times 10^4$

48

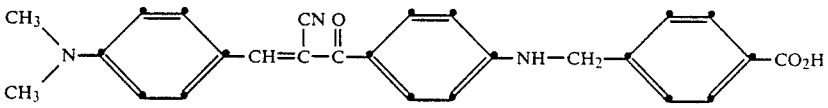

49

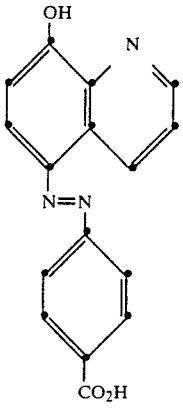

50

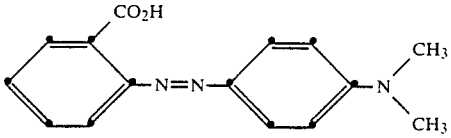

TABLE VII-continued
Miscellaneous Dyes
Dye
51
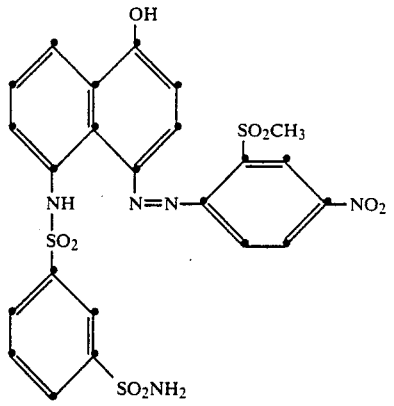
52
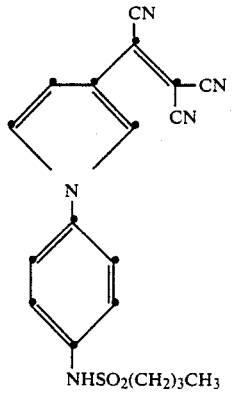
53
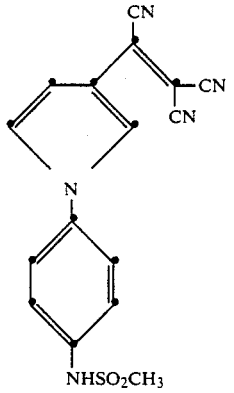
54
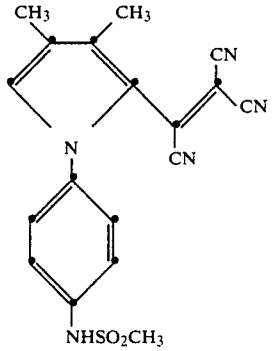

TABLE VII-continued

Miscellaneous Dyes

| Dye | |
|---|---|
| 55 | 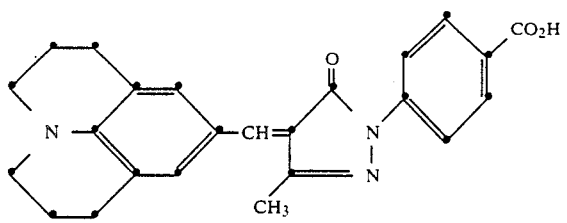 λ-max = 500 nm<br>ε-max = 5.82 × $10^4$ |

TABLE VIII

Arylidene Dyes

General Structure:

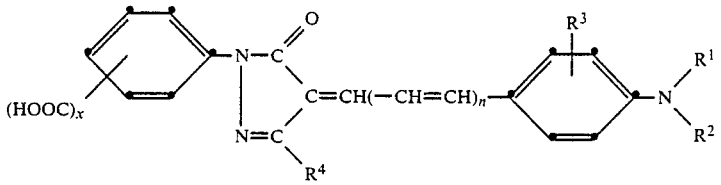

| Dye | $R^1$, $R^2$ | $R^3$ | $R^4$ | 1-Ph Substn. × Position | | n | λ-max (nm) | ε-max $(10)^4$ |
|---|---|---|---|---|---|---|---|---|
| 56 | $CH_3$ | H | $CH_3$ | 1 | 4 | 0 | 466 | 3.73 |
| 57 | $C_2H_5$ | H | $CH_3$ | 1 | 4 | 0 | 471 | 4.75 |
| 58 | n-$C_4H_9$ | H | $CH_3$ | 1 | 4 | 0 | 475 | 4.50 |
| 59 | $CH_3$ | H | $COOC_2H_5$ | 1 | 4 | 0 | 508 | 5.20 |
| 60 | i-$C_3H_7OCCH_2$ ‖ O | $CH_3$ | $CH_3$ | 1 | 4 | 0 | 430 | 3.34 |
| 61 | $CH_3$ | H | $CH_3$ | 2 | 3,5 | 0 | 457 | 3.78 |
| 62 | $C_2H_5$ | H | $CH_3$ | 2 | 3,5 | 0 | 475 | 4.55 |
| 63 | n-$C_4H_9$ | H | $CH_3$ | 2 | 3,5 | 0 | 477 | 4.92 |
| 64 | i-$C_3H_7OCCH_2$ ‖ O | H | $CH_3$ | 2 | 3,5 | 0 | 420 | 3.62 |
| 65 | i-$C_3H_7OCCH_2$ ‖ O | $CH_3$ | $CH_3$ | 2 | 3,5 | 0 | 434 | 3.25 |
| 66 | i-$C_3H_7OCCH_2$ | H | $CH_3$ | 1 | 4 | 0 | 420 | 3.94 |
| 67 | $CH_3$ | H | O ‖ C $CH_3$ | 1 | 4 | 1 | 573 | 5.56 |
| 68 | $CH_3$ | H | COOEt | 1 | 3,5 | 0 | 502 | 4.83 |
| 69 | $C_2H_5$ | H | COOEt | 1 | 4 | 0 | 512 | 6.22 |
| 70 | $CH_3$ | H | $CF_3$ | 1 | 4 | 0 | 507 | 4.58 |
| 71 | $CH_3$ | H | Ph | 1 | 4 | 0 | 477 | 4.54 |
| 72 | $CH_3$ | H | O ‖ C $CH_3$ | 1 | 4 | 0 | 506 | 5.36 |

TABLE IX
Oxazole and Oxazoline Pyrazolone Merocyanine Dyes
73
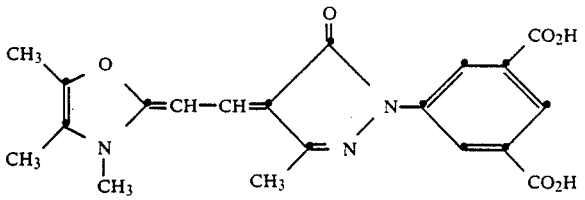
74
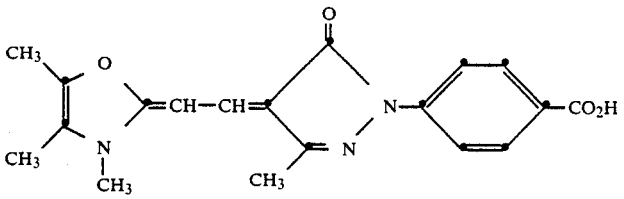
75
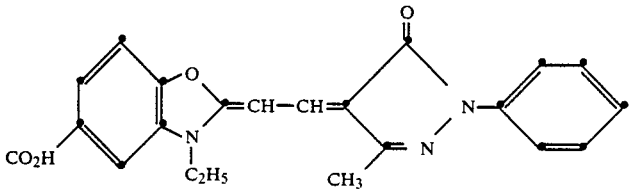
76
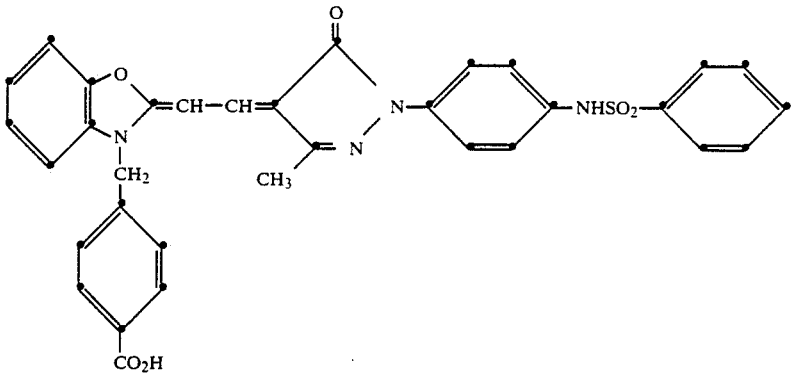
77
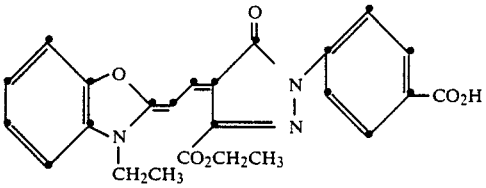
78
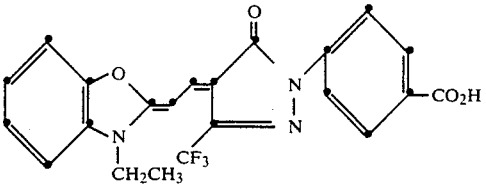

TABLE IX-continued
Oxazole and Oxazoline Pyrazolone Merocyanine Dyes
79
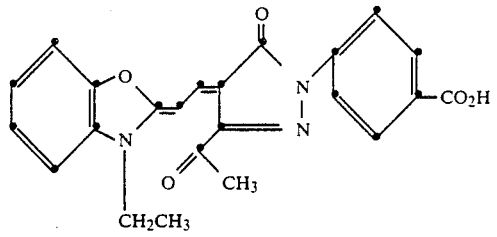
80
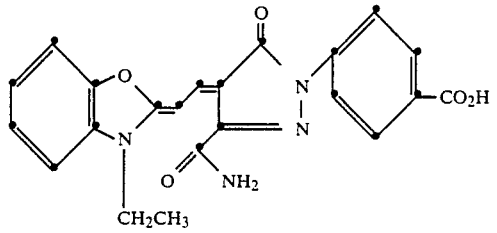
81
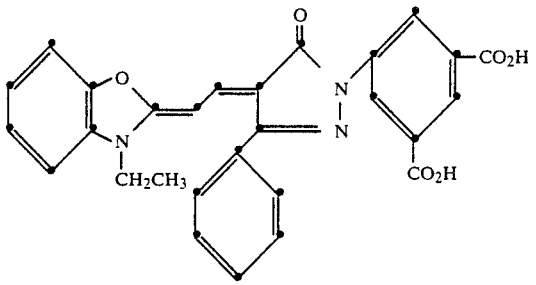
82
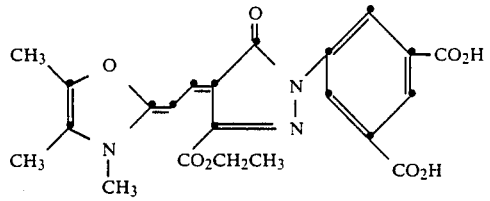
83
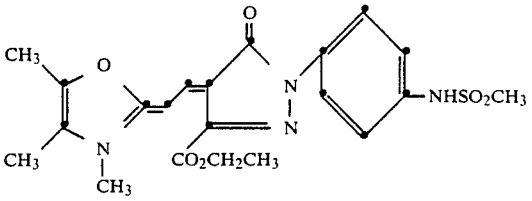
84
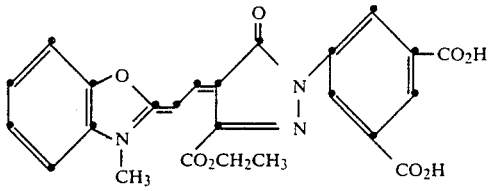

TABLE IX-continued
Oxazole and Oxazoline Pyrazolone Merocyanine Dyes
85
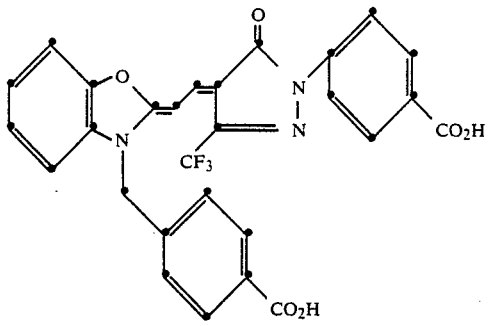
86
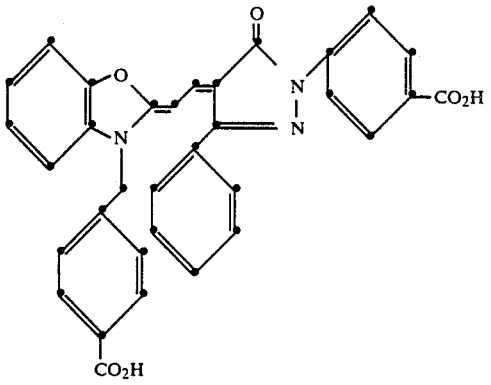
87
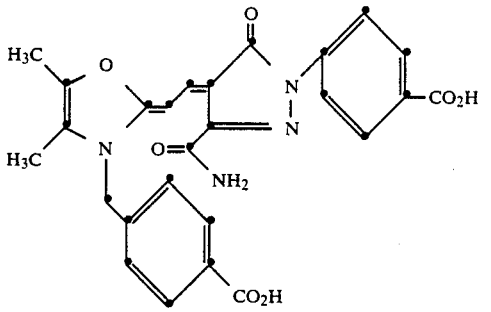
88
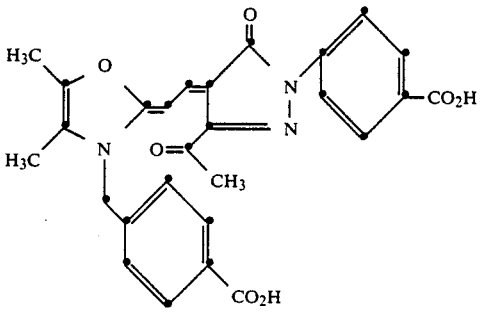

TABLE IX-continued
Oxazole and Oxazoline Pyrazolone Merocyanine Dyes
89
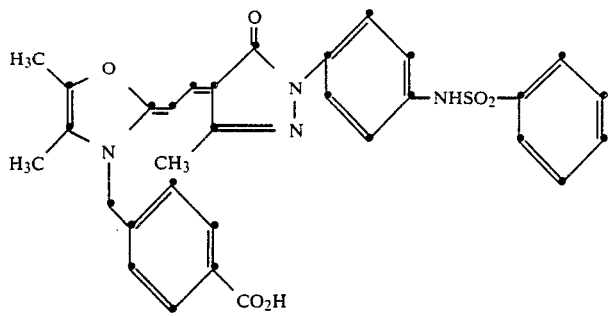
90
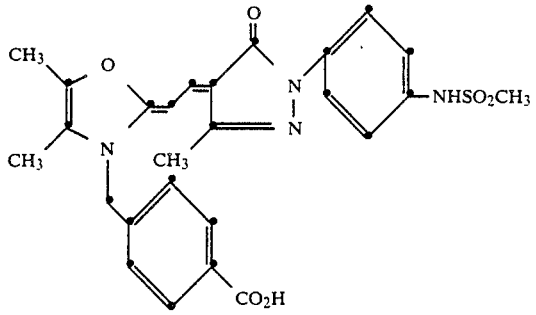
91
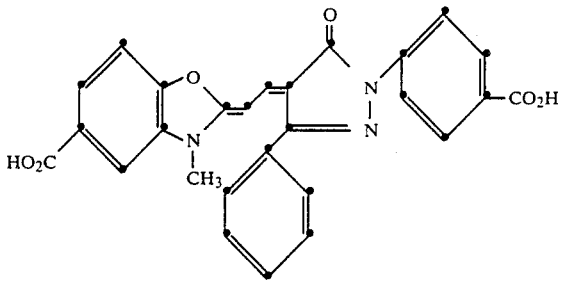
92
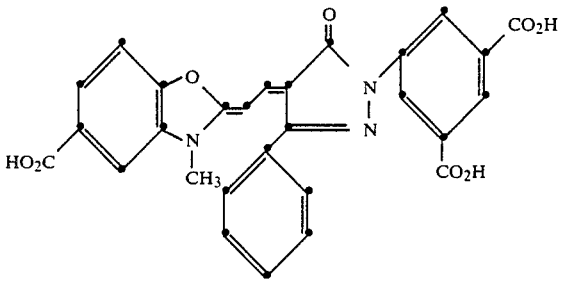
93
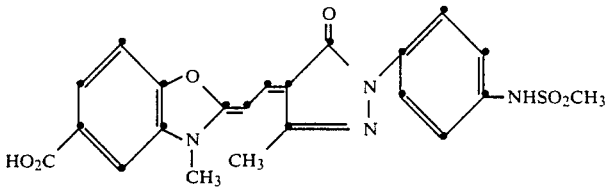

TABLE IX-continued
Oxazole and Oxazoline Pyrazolone Merocyanine Dyes
94
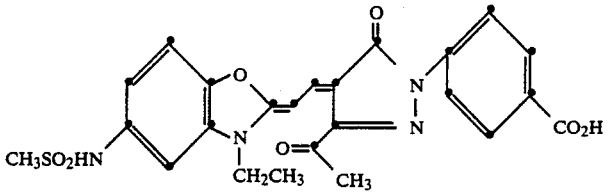
95
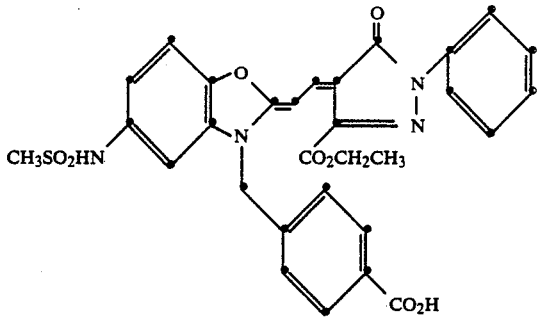
96
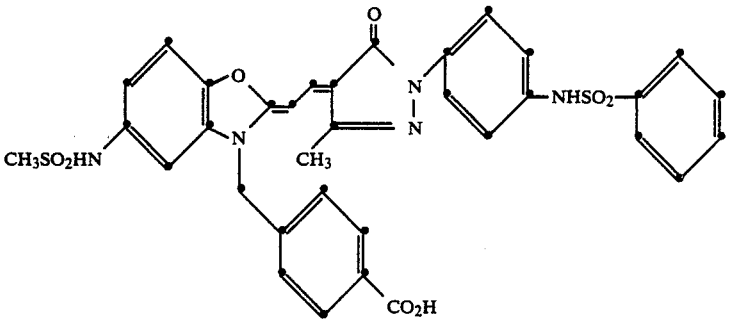
97
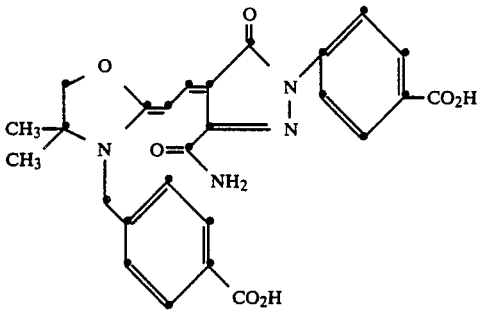
98
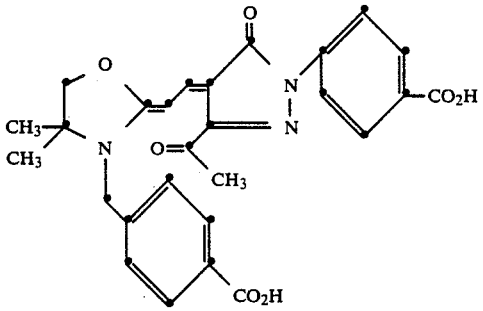

TABLE IX-continued
| Oxazole and Oxazoline Pyrazolone Merocyanine Dyes |
|---|
| 99 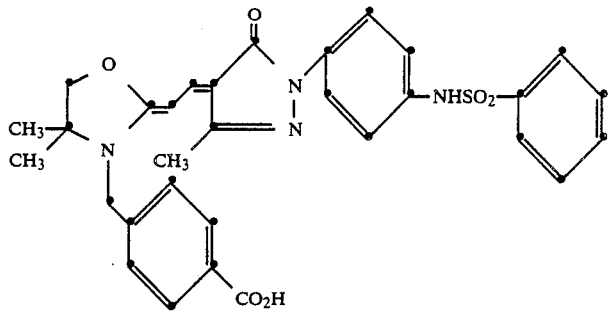 |
TABLE X
| Oxazole and Oxazoline Benzoylacetonitrile Merocyanine Dyes |
|---|
| 100 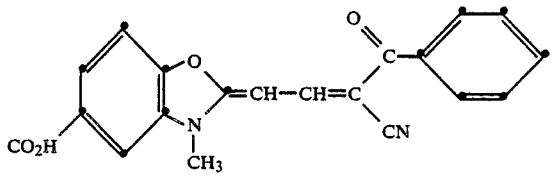 |
| 101 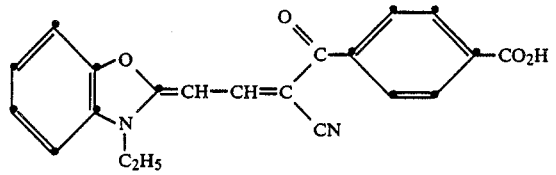 |
| 102 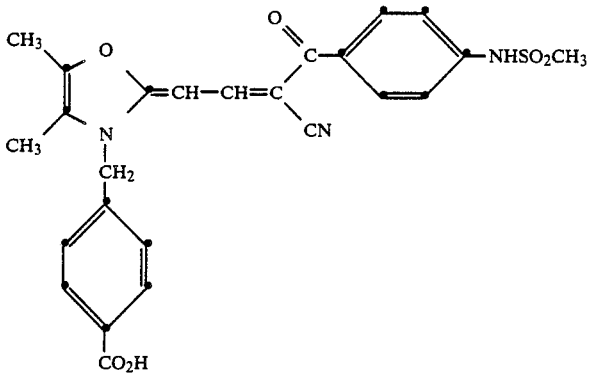 |
| 103 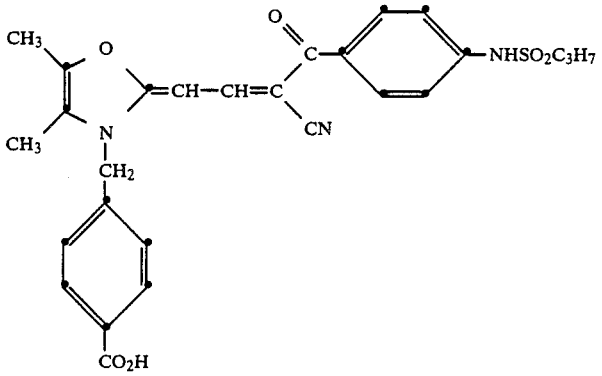 |

TABLE X-continued
Oxazole and Oxazoline Benzoylacetonitrile Merocyanine Dyes
104
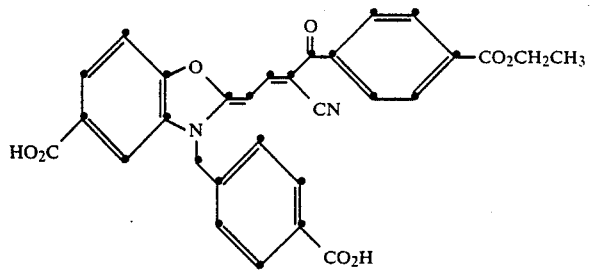
105
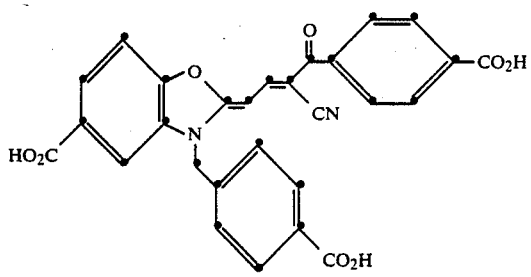
106
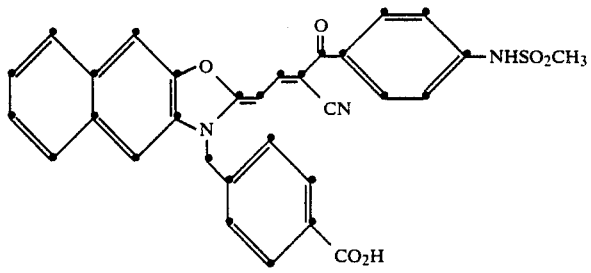
107
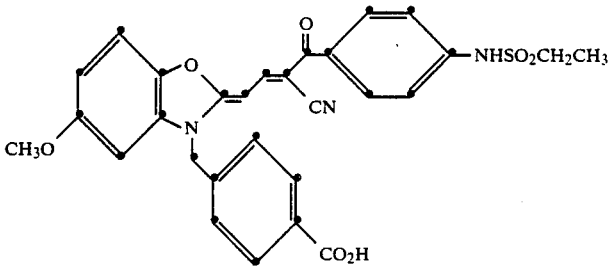
108
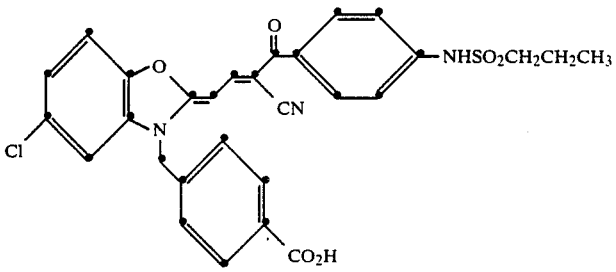

TABLE X-continued
Oxazole and Oxazoline Benzoylacetonitrile
Merocyanine Dyes
109
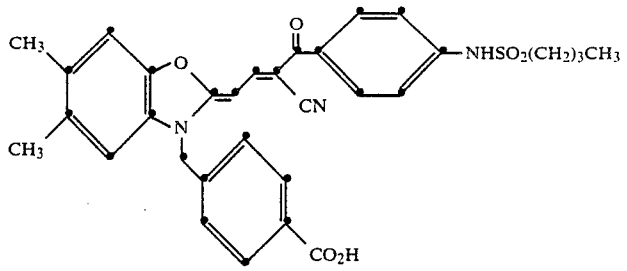
110
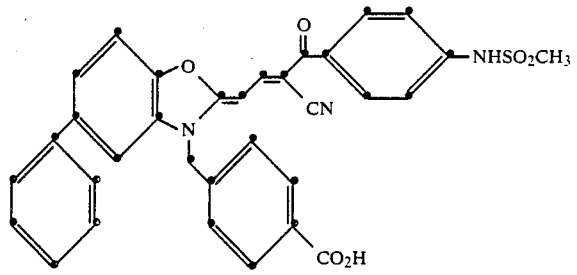
111
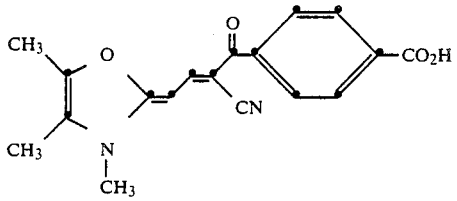
112
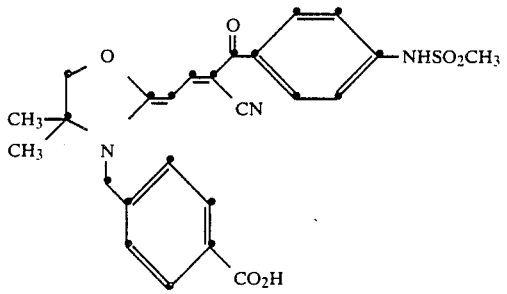
113
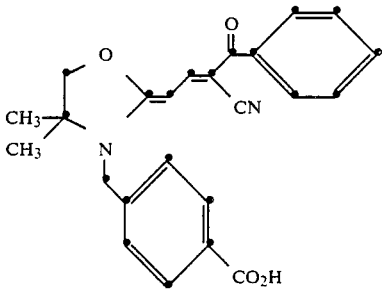

TABLE X-continued
| Oxazole and Oxazoline Benzoylacetonitrile Merocyanine Dyes | |
|---|---|
| 114 | 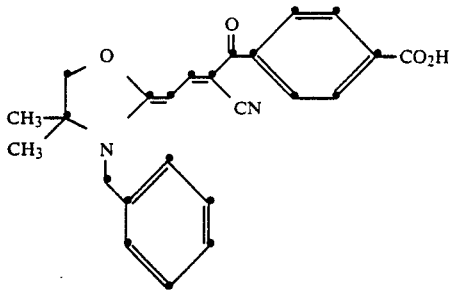 |
| 115 | 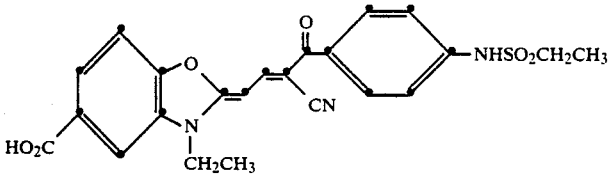 |
| 116 | 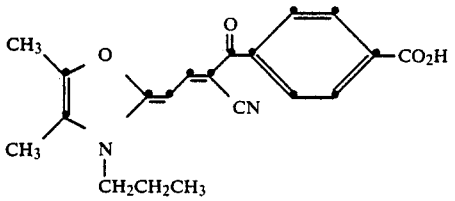 |
| 117 | 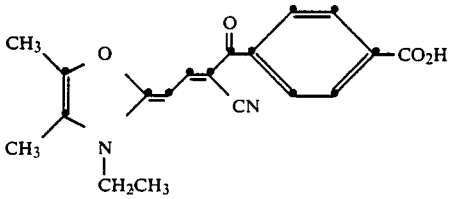 |
| 118 | 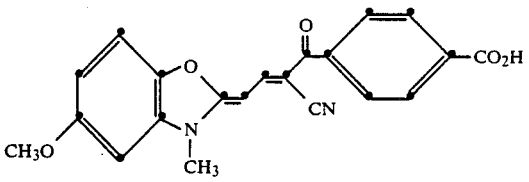 |
| 119 | 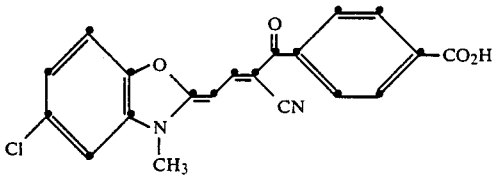 |
| 120 | 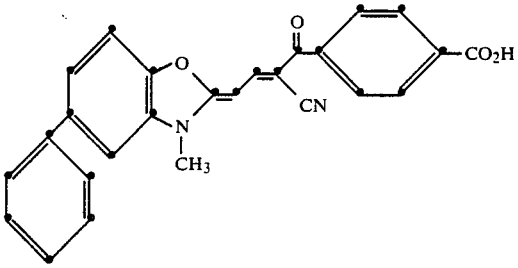 |

TABLE X-continued

Oxazole and Oxazoline Benzoylacetonitrile Merocyanine Dyes

121

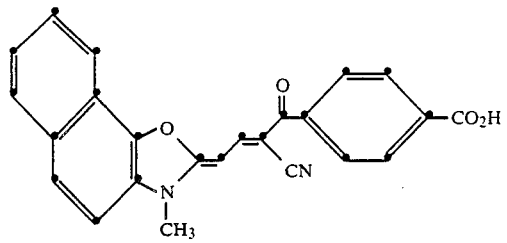

122

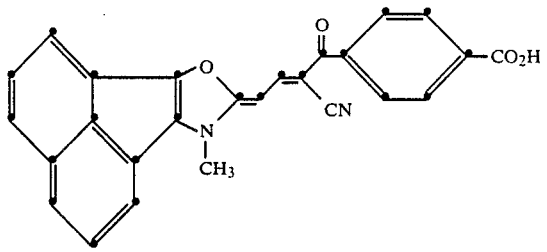

123

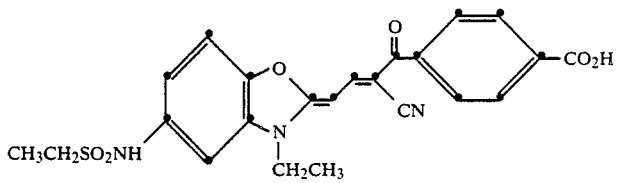

124

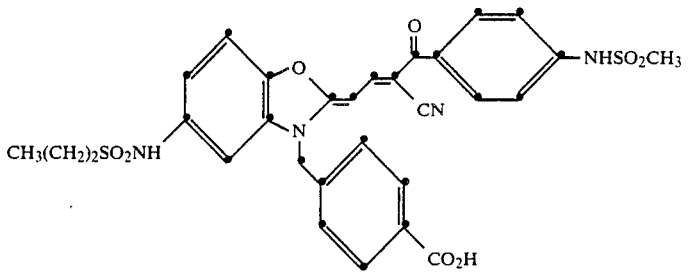

TABLE XI

Oxonol Dyes

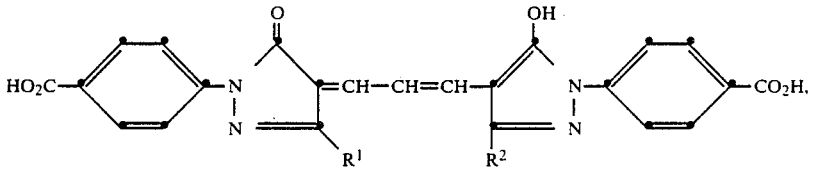

wherein

| Dye | $R^1$ | $R^2$ |
|---|---|---|
| 125 | $CH_3$ | $CH_3$ |
| 126 | $C_2H_5$ | $C_2H_5$ |

The dye can be added directly to the hydrophilic colloid as a particulate solid or can be converted to a particulate solid after it is added to the hydrophilic colloid. One example of the latter technique is to dissolve a dye which is not water soluble in a solvent which is water soluble. When the dye solution is mixed with an aqueous hydrophilic colloid, followed by noodling and washing of the hydrophilic colloid (see *Research Disclosure*, Item 17643, cited above, Section II), the dye solvent is removed, leaving particulate dye dispersed within the hydrophilic colloid. Thus, any water insoluble dye which that is soluble in a water miscible organic solvent can be employed as a particulate dye in the practice of the invention, provided the dye is susceptible to bleaching under processing conditions — e.g., at alkaline pH levels Specific examples of contemplated water miscible organic solvents are methanol, ethyl acetate, cyclohexanone, methyl ethyl 2-(2-butoxyethoxy)ethyl acetate, triethyl phosphate, methylacetate, acetone, ethanol, and dimethylformamide. Dyes preferred for use with these solvents are sulfonamide substituted arylidene dyes, specifically preferred examples of which are set forth about in Tables IIA and III.

In addition to being present in particulate form and satisfying the optical density requirements set forth above, the dyes employed in the under layer units must be substantially decolorized on processing. The term "substantially decolorized" is employed to mean that the dye in the under layer units raises the minimum density of the radiographic element when fully processed under the reference processing conditions, stated above, by no more than 0.1, preferably no more than 0.05, within the visible spectrum. As shown in the examples below the preferred particulate dyes produce no significant increase in the optical density of fully processed radiographic elements of the invention.

As indicated above, it is specifically contemplated to employ a UV absorber, preferably blended with the dye in each of crossover reducing layers 111 and 113. Any conventional UV absorber can be employed for this purpose. Illustrative useful UV absorbers are those disclosed in *Research Disclosure*, Item 18431, cited above, Section V, or *Research Disclosure*, Item 17643, cited above, Section VIII(C), both here incorporated by reference. Preferred UV absorbers are those which either exhibit minimal absorption in the visible portion of the spectrum or are decolorized on processing similarly as the crossover reducing dyes.

Overlying the under layer unit on each major surface of the support is at least one additional hydrophilic colloid layer, specifically at one halide emulsion layer unit comprised of a spectrally sensitized silver bromide or bromoiodide tabular grain emulsion layer. At least 50 percent (preferably at least 70 percent and optimally at least 90 percent) of the total grain projected area of the tabular grain emulsion is accounted for by tabular grains having a thickness less than 0.3 μm (preferably less than 0.2 μm) and an average aspect ratio of greater than 5:1 (preferably greater than 8:1 and optimally at least 12:1). Preferred tabular grain silver bromide and bromoiodide emulsions are those disclosed by Wilgus et al U.S. Pat. No. 4,434,226; Kofron et al U.S. Pat. No. 4,439,530; Abbott et al U.S. Pat. Nos. 4,425,425 and 4,425,426; Dickerson U.S. Pat. No. 4,414,304; Maskasky U.S. Pat. No. 4,425,501; and Dickerson U.S. Pat. No. 4,520,098: the disclosures of which are here incorporated by reference.

Both for purposes of achieving maximum imaging speed and minimizing crossover the tabular grain emulsions are substantially optimally spectrally sensitized. That is, sufficient spectral sensitizing dye is adsorbed to the emulsion grain surfaces to achieve at least 60 percent of the maximum speed attainable from the emulsions under the contemplated conditions of exposure. It is known that optimum spectral sensitization is achieved at about 25 to 100 percent or more of monolayer coverage of the total available surface area presented by the grains. The preferred dyes for spectral sensitization are polymethine dyes, such as cyanine, merocyanine, hemicyanine, hemioxonol, and merostyryl dyes. Specific examples of spectral sensitizing dyes and their use to sensitize tabular grain emulsions are provided by Kofron et al U.S. Pat. No. 4,439,520, here incorporated by reference.

Although not a required feature of the invention, the tabular grain emulsions are rarely put to practical use without chemical sensitization. Any convenient chemical sensitization of the tabular grain emulsions can be undertaken. The tabular grain emulsions are preferably substantially optimally (as defined above) chemically and spectrally sensitized. Useful chemical sensitizations, including noble metal (e.g., gold) and chalcogen (e.g., sulfur and/or selenium) sensitizations as well as selected site epitaxial sensitizations, are disclosed by the patents cited above relating to tabular grain emulsions, particularly Kofron et al and Maskasky.

In addition to the grains and spectral sensitizing dye the emulsion layers can include as vehicles any one or combination of various conventional hardenable hydrophilic colloids alone or in combination with vehicle extenders, such as latices and the like. The vehicles and vehicle extenders of the emulsion layer units can be identical to those of the interlayer units. The vehicles and vehicle extenders can be selected from among those disclosed by *Research Disclosure*, Item 17643, cited above, Section IX, here incorporated by reference. Specifically preferred hydrophilic colloids are gelatin and gelatin derivatives.

The coating coverages of the emulsion layers are chosen to provide on processing the desired maximum density levels. For radiography maximum density levels are generally in the range of from about 3 to 4, although specific applications can call for higher or lower density levels. Since the silver images produced on opposite sides of the support are superimposed during viewing, the optical density observed is the sum of the optical densities provided by each emulsion layer unit. Assuming equal silver coverages on opposite major surfaces of the support, each emulsion layer unit should contain a silver coverage from about 18 to 30 mg/dm$^2$, preferably 21 to 27 mg/dm$^2$ It is conventional practice to protect the emulsion layers from damage by providing overcoat layers. The overcoat layers can be formed of the same vehicles and vehicle extenders disclosed above in connection with the emulsion layers. The overcoat layers are most commonly gelatin or a gelatin derivative.

To avoid wet pressure sensitivity the total hydrophilic colloid coverage on each major surface of the support must be at least 35 mg/dm$^2$ It is an observation of this invention that it is the total hydrophilic colloid coverage on each surface of the support and not, as has been generally believed, simply the hydrophilic colloid coverage in each silver halide emulsion layer that controls its wet pressure sensitivity. Thus, with 10 mg/dm$^2$ of hydrophilic colloid being required in the interlayer unit for coating uniformity, the emulsion layer can contain as little as 20 mg/dm$^2$ of hydrophilic colloid.

To allow rapid access processing of the radiographic element the total hydrophilic coating coverage on each major surface of the support must be less than 65 mg/dm$^2$, preferably less than 55 mg/dm$^2$, and the hydrophilic colloid layers must be substantially fully forehardened. By substantially fully forehardened it is meant that the processing solution permeable hydrophilic colloid layers are forehardened in an amount sufficient to reduce swelling of these layers to less than 300 percent, percent swelling being determined by the following reference swell determination procedure: (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b). This reference procedure for measuring forehardening is disclosed by Dickerson U.S. Pat. No. 4,414,304. Employing this reference procedure, it is preferred that the hydrophilic colloid layers be sufficiently forehardened that swelling is reduced to less than 200 percent under the stated test conditions.

Any conventional transparent radiographic element support can be employed. Transparent film supports, such as any of those disclosed in *Research Disclosure*, Item 17643, cited above, Section XIV, are all contemplated. Due to their superior dimensional stability the transparent film supports preferred are polyester supports. Poly(ethylene terephthalate) is a specifically preferred polyester film support. The support is typically tinted blue to aid in the examination of image patterns. Blue anthracene dyes are typically employed for this purpose. In addition to the film itself, the support is usually formed with a subbing layer on the major surface intended to receive the under layer units. For further details of support construction, including exemplary incorporated anthracene dyes and subbing layers, refer to *Research Disclosure*, Item 18431, cited above, Section XII.

In addition to the features of the radiographic elements of this invention set forth above, it is recognized that the radiographic elements can and in most practical applications will contain additional conventional features. Referring to *Research Disclosure*, Item 18431, cited above, the emulsion layer units can contain stabilizers, antifoggants, and antikinking agents of the type set forth in Section II, and the overcoat layers can contain any of variety of conventional addenda of the type set forth in Section IV. The outermost layers of the radiographic element can also contain matting agents of the type set out in *Research Disclosure*, Item 17643, cited above, section XVI. Referring further to *Research Disclosure*, Item 17643, incorporation of the coating aids of Section XI, the plasticizers and lubricants of Section XII, and the antistatic layers of Section XIII, are each contemplated.

EXAMPLES

The invention can be better appreciated by reference to the following specific examples:

Screens

The following intensifying screens were employed:

Screen X

This screen has a composition and structure corresponding to that of a commercial, general purpose screen. It consists of a terbium activated gadolinium oxysulfide phosphor having a median particle size of 7 μm coated on a white pigmented polyester support in a Permuthane TM polyurethane binder at a total phosphor coverage of 7.0 g/dm$^2$ at a phosphor to binder ratio of 15:1.

Screen Y

This screen has a composition and structure corresponding to that of a commercial, medium resolution screen. It consists of a terbium activated gadolinium oxysulfide phosphor having a median particle size of 7 μm coated on a white pigmented polyester support in a Permuthane TM polyurethane binder at a total phosphor coverage of 5.9 g/dm$^2$ at a phosphor to binder ratio of 15:1 and containing 0.017535% by weight of a 100:1 weight ratio of a yellow dye and carbon.

Screen Z

This screen has a composition and structure corresponding to that of a commercial, high resolution screen. It consists of a terbium activated gadolinium oxysulfide phosphor having a median particle size of 5 μm coated on a blue tinted clear polyester support in a Permuthane TM polyurethane binder at a total phosphor coverage of 3.4 g/dm$^2$ at a phosphor to binder ratio of 21:1 and containing 0.0015% carbon.

Radiographic Exposures

Assemblies consisting of a double coated radiographic element sandwiched between a pair of intensifying screens were in each instance exposed as follows:

The assemblies were exposed to 70 KVp X-radiation, varying either current (mA) or time, using a 3-phase Picker Medical (Model VTX-650) TM X-ray unit containing filtration up to 3 mm of aluminum. Sensitometric gradations in exposure were achieved by using a 21-increment (0.1 log E) aluminum step wedge of varying thickness.

Element A (example) (Em.LC)LXOA(Em.HC)

Radiographic element A was a double coated radiographic element exhibiting near zero crossover.

Radiographic element A was constructed of a low crossover support composite (LXO) consisting of a blue-tinted transparent polyester film support coated on each side with a crossover reducing layer consisting of gelatin (1.6 g/m$^2$) containing 320 mg/m$^2$ of a 1:1 weight ratio mixture of Dyes 56 and 59.

Low contrast (LC) and high contrast (HC) emulsion layers were coated on opposite sides of the support over the crossover reducing layers. Both emulsions were green-sensitized high aspect ratio tabular grain silver bromide emulsions, where the term "high aspect ratio" is employed as defined by Abbott et al U.S. Pat. No. 4,425,425 to require that at least 50 percent of the total grain projected area be accounted for by tabular grains having a thickness of less than 0.3 μm and having an average aspect ratio of greater than 8:1. The low contrast emulsion was a 1:1 (silver ratio) blend of a first emulsion which exhibited an average grain diameter of 3.0 μm and an average grain thickness of 0.13 μm and a second emulsion which exhibited an average grain diameter of 1.2 μm and an average grain thickness of 0.13 μm. The high contrast emulsion exhibited an average grain diameter of 1.7 μm and an average grain thickness of 0.13 μm. The high contrast emulsion exhibited less polydispersity than the low contrast emulsion. Both the high and low contrast emulsions were spectrally sensitized with 400 mg/Ag mol of anhydro-5,5-dichloro-9-ethyl-3,3'-bis(3-sulfopropyl)oxacarbocyanine hydroxide, followed by 300 mg/Ag mol of potassium iodide. The emulsion layers were each coated with a silver coverage of 2.42 g/m$^2$ and a gelatin coverage of 3.22 g/m$^2$. Protective gelatin layers (0.69 g/m$^2$ were coated over the emulsion layers. Each of the gelatin containing layers were hardened with bis(vinylsulfonylmethyl) ether at 1% of the total gelatin.

When coated as described above, but symmetrically, with Emulsion LC coated on both sides of the support and Emulsion HC omitted, using a Screen X pair, Emulsion LC exhibited a relative log speed of 98 and an average contrast of 1.8. Similarly, Emulsion HC when coated symmetrically with Emulsion LC omitted exhibited a relative log speed of 85 and an average contrast of 3.0. The emulsions thus differed in average contrast by 1.2 while differing in speed by 13 relative log speed units (or 0.13 log E).

When Element A was tested for crossover as described by Abbott et al U.S. Pat. No. 4,425,425, it exhibited a crossover of 2%.

Element B (control) (Em.L)HXOB(Em.L)

Radiographic element B was a conventional double coated radiographic element exhibiting extended exposure latitude.

Radiographic element B was constructed of a blue-tinted transparent polyester film support lacking the crossover reducing layers of radiographic element A. Identical emulsion layers (L) were coated on opposite sides of the support. The emulsion employed was a green-sensitized polydispersed silver bromoiodide emulsion. The same spectral sensitizing dye was employed as in Element A, but only 42 mg/Ag mole was required, since the emulsion was not a high aspect ratio tabular grain emulsion and therefore required much less dye for substantially optimum sensitization. Each emulsion layer was coated to provide a silver coverage of 2.62 g/m$^2$ and a gelatin coverage of 2.85 g/m$^2$. Protective gelatin layers (0.70 g/m$^2$) were coated over the emulsion layers. Each of the layers were hardened with bis(vinylsulfonylmethyl) ether at 0.5% of the total gelatin.

When coated as described above, using a Screen X pair, the film exhibited a relative log E speed of 80 and an average contrast of 1.6.

When Element B was tested for crossover as described by Abbott et al U.S. Pat. No. 4,425,425, it exhibited a crossover of 25%.

Element C (control) (Em.MC)HXOC(Em.MC)

Radiographic element C was a conventional double coated radiographic element of a type employed on occasion for chest cavity examinations.

Radiographic element C was constructed like radiographic element B, except that medium contrast emulsion layers (MC) were employed and the silver coverage of each emulsion layer was reduced to 1.93 g/m$^2$.

When coated as described above, using a Screen X pair, the film exhibited a relative log E speed of 80 and an average contrast of 2.6.

When Element C was tested for crossover as described by Abbott et al U.S. Pat. No. 4,425,425, it exhibited a crossover of 30%.

Element D (control) (Em.HC)HXOD(Em.HC)

Radiographic element D was a conventional high aspect ratio tabular grain double coated radiographic element of a type employed on occasion for chest examinations of subjects having low chest densities—i.e., children or adults of slight build.

Radiographic element D was constructed like radiographic: element A, except that no crossover reducing layers were coated on the film support and a high contrast emulsion (HC) similar to that employed in radiographic element A was coated on both sides of the support.

When coated as described above, using a Screen X pair, the film exhibited a relative log E speed of 80 and an average contrast of 2.9.

When Element C was tested for crossover as described by Abbott et al U.S. Pat. No. 4,425,425, it exhibited a crossover of 20%.

Processing

The films were processed in 90 seconds. In a commercially available Kodak RP X-Omat (Model 6B) TM rapid access processor as follows:

| | |
|---|---|
| development | 20 seconds at 35° C., |
| fixing | 12 seconds at 35° C., |
| washing | 8 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

Sensitometry

Optical densities are expressed in terms of diffuse density as measured by an X-rite Model 310 TM densitometer, which was calibrated to ANSI standard PH 2.19 and was traceable to a National Bureau of Standards calibration step tablet. The characteristic curve (density vs. log E) was plotted for each radiographic element processed. The average gradient, presented in Table XII below under the heading Contrast, was determined from the characteristic curve at densities of 0.25 and 2.0 above minimum density.

Assemblies

Two assemblies were formed by placing Element A (satisfying the requirements of the invention) and each of the control elements, Elements B, C, and D, between a pair of intensifying screens as indicated in Table XII.

TABLE XII

| Screen/Film Assembly | Contast | | | |
|---|---|---|---|---|
| | Average | Lung | Heart | |
| I. Z(Em.LC)LXOA(Em.HC)X | 1.5 | 100 | 100 | (Example) |
| II. Z(Em.L)HXOB(Em.L)X | 1.6 | 100 | 60 | (Control) |

TABLE XII-continued

| Screen/Film Assembly | Contast Average | Lung | Heart | |
|---|---|---|---|---|
| III. X(Em.L)HXOB(Em.L)Z | 1.6 | 100 | 60 | (Control) |
| IV. X(Em.L)HXOB(Em.L)X | 1.6 | 100 | 60 | (Control) |
| V. Z(Em.MC)HXOC(Em.MC)Z | 2.6 | 115 | 20 | (Control) |
| VI. Z(Em.HC)HXOD(Em.HC)Z | 2.9 | 130 | 20 | (Control) |
| VII. Z(Em.FLC)LXOE(Em.SHC)X | 2.5 | 115 | 40 | (Example) |
| VIII. Z(Em.SHC)LXOE(Em.FLC)X | 1.5 | 69 | 266 | (Example) |

From Table XII it is apparent that assemblies I to IV all produced similar average contrasts when exposed between pairs of intensifying screens. The relative lung contrast, reported as 100, was selected as the contrast corresponding to a density of 1.8, which is a commonly accepted density for reading lung features in a radiograph. Relative heart contrast was then fixed as the contrast corresponding to a 1.0 log E lower exposure level, reflecting the fact that the heart normally absorbs about 10 times the X-radiation absorbed by the lungs and therefore allows only about one tenth of the X-radiation to reach the radiographic element in the heart image area that reaches the radiographic element in the lung image areas. While Assembly I exhibited a lower contrast in its heart image areas than in its lung image areas, the heart image area for Assembly I was assigned a relative contrast of 100 for the purpose of comparing contrasts in the heart image areas of the various assemblies. In comparing the relative heart area contrasts of Assemblies II to IV inclusive with that of Assembly I, it was observed that these latter assemblies provided only 60 percent of the contrast made available by Assembly I. The heart area contrasts were sufficiently low in the control assemblies as to require skilled observation to distinguish significant image features, whereas the much larger heart region relative contrasts provided by Assembly I containing the double coated radiographic element of the invention were clearly discernible with much less visual effort. Assemblies II, III, and IV demonstrate that screen manipulation was ineffective in influencing the contrasts observed using the conventional extended latitude radiographic element.

Assemblies V and VI were included in Table XII to demonstrate the clear inferior image contrast observed in heart areas using conventional radiographic films of types sometimes used for chest cavity examinations, but not specifically designed for this use. With a relative contrast of only 20 in heart areas, radiographic elements C and D clearly have limited utility in chest cavity examinations of heart areas.

It has been demonstrated in Dickerson et al (III) U.S. Ser. No. 314,341, filed Feb. 23, 1989, titled RADIOGRAPHIC ELEMENTS WITH SELECTED SPEED RELATIONSHIPS, commonly assigned, now abandoned in favor of U.S. Ser. No. 385,114, filed July 26, 1989, that double coated radiographic elements exhibiting crossover levels of less than 10 percent and a first emulsion layer unit on one side of a transparent film support that is at least twice, preferably 2 to 10 times, and optimally 2 to 4 times, the speed of a second emulsion layer unit on the opposite side of the support exhibit different average contrasts when employed in combination with different screen pair combinations. From these related investigations it has been concluded that substitution of Film A for Film B in either of Assemblies III or IV would have produced higher average contrasts and, in all probability, higher contrasts in the heart image areas.

Assemblies V and VI were constructed to demonstrate that further advantages that can be realized by combining the teachings of Dickerson et al (III) with the teachings of this patent application.

Element E (example)(Em.FLC)LXOE(Em.SHC)

Radiographic element E was a double coated radiographic element exhibiting near zero crossover.

Radiographic element E was constructed of a low crossover support composite (LXO) identical to that of element A, described above.

Fast low contrast (FLC) and slow high contrast (SHC) emulsion layers were coated on opposite sides of the support over the crossover reducing layers. Both emulsions were green-sensitized high aspect ratio tabular grain silver bromide emulsions sensitized and coated similarly as the emulsion layers of element A.

When coated symmetrically, with Emulsion FLC coated on both sides of the support and Emulsion SHC omitted, using a Screen X pair, Emulsion FLC exhibited a relative log speed of 113 and an average contrast of 1.98. Similarly, Emulsion SHC when coated symmetrically with Emulsion FLC omitted exhibited a relative log speed of 69 and an average contrast of 2.61. The emulsions thus differed in average contrast by 0.63 while differing in speed by 44 relative log speed units (or 0.44 log E).

When Element E was tested for crossover as described by Abbott et al U.S. Pat. No. 4,425,425, it exhibited a crossover of 2%.

Referring to Table XII, it is apparent that orienting the Film E with the fast low contrast emulsion layer adjacent the front screen Z produced results comparable to that obtained control Film C, except that a very advantageous doubling of relative contrast in the heart region was observed. When the Film E was reversed, contrast in the lung areas was reduced somewhat, but remained well within the range of obtaining useful information from lung image areas. At the same time relative contrast in the heart region was increased to 266. Thus, this combination appears superior to all others in Table XII for obtaining image information from heart areas.

The foregoing comparisons provide a striking demonstration of the advantages which a radiologist can realize from the present invention. The present invention offers the radiologist an improved diagnostic capability over an extended range of radiographic element exposures in studying a single radiographic image.

The invention has been described in detail with particular reference to preferred embodiments thereof, but it will be understood that variations and modifications can be effected within the spirit and scope of the invention.

What is claimed is:

1. A radiographic element comprised of a transparent film support, first and second silver halide emulsion layer units coated on opposite sides of the film support, and means for reducing to less than 10 percent crossover of electromagnetic radiation of wavelengths longer than 300 nm capable of forming a latent image in the silver halide emulsion layer units, said crossover reducing means being decolorized in less than 90 seconds during processing of said emulsion layer units, characterized in that the first silver halide emulsion layer unit exhibits an average contrast of less than 2.0, based on density measurements at 0.25 and 2.0 above minimum density and the second silver halide emulsion layer unit exhibits an average contrast of at least 2.5, based on density measurements at 0.25 and 2.0 above minimum density, the contrast of the first silver halide emulsion layer unit being determined with the first silver halide emulsion unit replacing the second silver halide emulsion unit to provide an arrangement with the first silver halide emulsion unit present on both sides of the transparent support and the contrast of the second silver halide emulsion layer unit being determined with the second silver halide emulsion unit replacing the first silver halide emulsion unit to provide an arrangement with the second silver halide emulsion layer unit present on both sides of the transparent support.

2. A radiographic element according to claim 1 further characterized in that the first silver halide emulsion layer unit exhibits an average contrast that differs by 0.5 to 3.5 from that of the second silver halide emulsion layer unit.

3. A radiographic element according to claim 2 further characterized in that the first silver halide emulsion layer unit exhibits an average contrast that differs by 1.0 to 2.5 from that of the second silver halide emulsion layer unit.

4. A radiographic element according to claim 2 further characterized in that the first silver halide emulsion layer unit exhibits an average contrast that differs by 0.5 to 2.0 from that of the second silver halide emulsion layer unit.

5. A radiographic element according to claim 1 further characterized in that said crossover reducing means decreases crossover to less than 5 percent.

6. A radiographic element according to claim 5 further characterized in that said crossover reducing means decreases crossover to less than 3 percent.

7. A radiographic element according to claim 1 further characterized in that the first silver halide emulsion layer unit exhibits a speed that is at least equal to that of the second silver halide emulsion layer unit.

8. A radiographic element according to claim 7 further characterized in that the first silver halide emulsion layer unit exhibits a faster speed than that of the second silver halide emulsion layer unit.

9. A radiographic element according to claim 1 further characterized in that the crossover reducing means is comprised of a hydrophilic colloid layer interposed between at least one of said silver halide emulsion layer units and said support containing a dye capable of absorbing electromagnetic radiation to which said silver halide emulsion layer unit on the opposite side of the support is responsive.

10. A radiographic element according to claim 9 further characterized in that the dye in said interposed layer is, prior to processing, in the form of particles and is capable of being decolorized during processing.

11. A radiographic element according to claim 1 further characterized in said silver halide emulsion layer units are comprised of emulsions in which tabular silver halide grains having a thickness of less than 0.3 μm exhibit an average aspect ratio of greater than 5:1 and account for greater than 50 percent of the total grain projected area.

12. A radiographic element according to claim 11 further characterized in that said silver halide emulsion layer units are spectrally sensitized to at least 60 percent of their highest attainable sensitivities.

13. A radiographic element according to claim 12 further characterized in said silver halide emulsion layer units are comprised of emulsions in which tabular silver halide grains having a thickness of less than 0.2 μm exhibit an average aspect ratio of greater than 8:1 and account for greater than 70 percent of the total grain projected area.

14. A radiographic element according to claim 1 further characterized in that said emulsion layer units and crossover reducing means are each comprised of processing solution permeable hardenable hydrophilic colloid layers, said crossover reducing means includes a hydrophilic colloid layer interposed between one of said emulsion layer units and said support containing a particulate dye capable of absorbing radiation to which said emulsion layer unit coated on the opposite side of the support is responsive and at least 10 $mg/dm^2$ of said hardenable hydrophilic colloid, said emulsion layer units contain a combined silver coating coverage sufficient to produce a maximum density on processing the range of from 3 to 4, a total of from 35 to 65 $mg/dm^2$ of processing solution permeable hardenable hydrophilic colloid is coated on each of said opposed major surfaces of said support, and said processing solution permeable hydrophilic colloid layers are forehardened in an amount sufficient to reduce swelling of said layers to less than 300 percent, percent swelling being determined by (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b), whereby said radiographic element exhibits high covering power, reduced crossover without emulsion desensitization, reduced wet pressure sensitivity, and can be developed, fixed, washed, and emerge dry to the touch in a 90 second process cycle consisting of

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time is transport between processing steps, the development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |

-continued

| | |
|---|---|
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

* * * * *